US012741804B2

(12) United States Patent
Gadde

(10) Patent No.: US 12,741,804 B2
(45) Date of Patent: Sep. 22, 2026

(54) APPARATUS FOR DISPENSING FOOD AND BEVERAGES

(71) Applicant: Pardha Saradhi Gadde, Hayes (GB)

(72) Inventor: Pardha Saradhi Gadde, Hayes (GB)

(73) Assignee: Pardha Saradhi Gadde, Hayes (GB)

( * ) Notice: Subject to any disclaimer, the term of this patent is extended or adjusted under 35 U.S.C. 154(b) by 278 days.

(21) Appl. No.: 18/447,336

(22) Filed: Aug. 10, 2023

(65) Prior Publication Data

US 2024/0010416 A1 Jan. 11, 2024

Related U.S. Application Data

(63) Continuation-in-part of application No. 18/042,463, filed on Feb. 22, 2023, now Pat. No. 12,458,160.

(51) Int. Cl.

| | |
|---|---|
| ***B65D 81/32*** | (2006.01) |
| ***B65D 25/02*** | (2006.01) |
| ***B65D 25/20*** | (2006.01) |
| ***B65D 43/02*** | (2006.01) |
| ***B65D 51/24*** | (2006.01) |
| ***B65D 77/04*** | (2006.01) |
| ***B65D 83/04*** | (2006.01) |

(52) U.S. Cl.

CPC ..... *B65D 83/0418* (2013.01); *B65D 25/02* (2013.01); *B65D 25/20* (2013.01); *B65D 43/0202* (2013.01); *B65D 51/24* (2013.01); *B65D 77/048* (2013.01); *B65D 2543/00092* (2013.01); *B65D 2577/043* (2013.01); *B65D 2583/0481* (2013.01)

(58) Field of Classification Search

CPC ..... B65D 81/3216; B65D 83/0418; B65D 2583/0481; B65D 25/00; B65D 25/02; B65D 25/20; A47K 10/427; G01N 33/48757; G01N 33/48778

USPC ..... 221/232, 270

See application file for complete search history.

(56) References Cited

U.S. PATENT DOCUMENTS

| | | | | | |
|---|---|---|---|---|---|
| 2,245,066 | A | * | 6/1941 | Bouchard | G07D 1/08 221/232 |
| 2,620,061 | A | * | 12/1952 | Uxa | B65D 83/0418 221/229 |
| 3,860,304 | A | * | 1/1975 | Bolton | A47K 10/422 221/98 |
| 4,589,575 | A | | 5/1986 | Rigberg et al. | |
| 5,056,681 | A | * | 10/1991 | Howes | B65D 25/00 220/521 |

(Continued)

*Primary Examiner* — Charles P. Cheyney

(74) *Attorney, Agent, or Firm* — Willie Jacques; Emanus LLC

(57) ABSTRACT

A portable apparatus for dispensing food and beverages is provided. The apparatus comprises a food chamber to hold stacked food items in the form of patties, fritter, cakes or semi-solid content and a drink chamber to dispense liquid or semi-solid liquid. The apparatus comprises a lever connected to the food chamber that forces the food content to release from the apparatus. The lever can be in form of slider lever, rotatable lever, flushed lever, horizontal lever, push button, push button with motor. The apparatus further comprises a lock and slid mechanism for reducing spring tension and to reduce friction on food content. The apparatus can be disposable, non-disposable or reusable or in modular form.

13 Claims, 39 Drawing Sheets

(56) References Cited

U.S. PATENT DOCUMENTS 5,099,232 A * 3/1992 Howes ..... B65D 81/3216 206/217
5,241,835 A * 9/1993 Ascone ..... F25D 3/08 220/501
5,335,816 A * 8/1994 Kaufman ..... G07F 11/14 221/124
6,394,306 B1 * 5/2002 Pawlo ..... B65D 83/0409 221/258
6,508,380 B1 * 1/2003 von Schuckmann ..... B65D 83/0835 221/6
6,564,967 B1 * 5/2003 Stringfield ..... B65D 83/0418 221/229
6,726,665 B1 * 4/2004 Embleton ..... A61F 9/0008 604/296
7,449,148 B2 * 11/2008 Matsumoto ..... G01N 33/48757 422/50
7,963,201 B2 * 6/2011 Willoughby ..... G07F 17/0092 83/210
8,955,707 B2 2/2015 Lim
9,033,184 B2 * 5/2015 Walter ..... B65D 83/10 221/256
9,179,749 B2 * 11/2015 Bernhard ..... B65D 51/28
10,071,846 B2 * 9/2018 Yao ..... B65D 83/0829
10,259,640 B2 * 4/2019 Yao ..... B65D 83/0817
10,292,906 B1 * 5/2019 Gershoni ..... B65D 83/0454
10,631,689 B2 * 4/2020 Trevizo ..... A47K 1/02
2003/0089730 A1 * 5/2003 May ..... B65H 1/00 221/232
2004/0026446 A1 * 2/2004 Mori ..... G07F 11/14 221/281
2013/0085349 A1 * 4/2013 Shaanan ..... A61B 5/15194 600/301
2015/0160186 A1 * 6/2015 Garner-Richards ..... A61B 5/150503 221/270

* cited by examiner

APPARATUS FOR DISPENSING FOOD AND BEVERAGES

CROSS-REFERENCE TO RELATED APPLICATIONS

This application is a continuation-in-part of U.S. Non-Provisional application Ser. No. 18/042,463 filed on 22 Feb. 2023, which claim benefit to a PCT application Ser. No. PCT/IB2022/058145 filed on 31 Aug. 2022 which claim benefit to U.S. Provisional Patent Application No. 63/240,858 filed 3 Sep. 2021 the contents of which are considered part of the disclosure of this application and are hereby incorporated by reference in their entireties.

FIELD OF THE INVENTION

The present invention relates to a portable food dispenser and drink container system that dispenses the food directly to the user, and more particularly, to a handheld food dispenser system that be used for carrying food and drink in a single apparatus.

BACKGROUND

Eating food with hands is a bit problem, especially for food items that easily fell apart. The person has to sit somewhere or remain stationary for a quick bite. Most of the time, food is not easy to pick and eat cleanly, especially during travelling, eating and drinking while driving or while working. Eating food while simultaneously doing some work is a hectic task. Another issue is that of maintenance of hygiene. Eating food through hand is not hygienic and cleaning hand thereafter is another hygienic issue.

Besides hygiene, eating food with hands while doing a work leads to distraction from the work. The distraction can occur due to eating food while driving, distraction among pilots and crew while eating food during the flight operation and distraction while working in industries leading to Industrial accidents. Furthermore, the spill can damage electronic circuit boards and can cause major issues.

Distracted driving is one of the leading causes of fatal car accidents worldwide. Eating and drinking in one's car poses a visual, physical and mental distraction. A driver will often avert one's vision from the road when unwrapping food or trying to prevent food from spilling and making a mess in one's vehicle. Eating and drinking can provide a physical distraction which can result in a car accident when trying to unwrap or hold the item while consuming the food or beverage. If a driver operates a stick shift, their odds of having a food related accident can double since eating, shifting, and steering requires increased dexterity.

Certain beverages, such as hot coffee, tea and soups may pose the most serious distracted driving risk. Hot liquids like beverages or soup can spill scalding a driver. A beverage that spills and scalds one's lap can obviously be a serious distraction while driving. Foods that are greasy or salty can create a hazard where the driver is searching the vehicle for something to clean one's hands. Beverages that lack straws require use of hand, eyes and mental concentration to open and/or close the drink. They also pose a spill risk, which means that a driver may focus on cleaning up a potential spill.

The National Highway Traffic Safety Administration (NHTSA) claims that 8% of fatal crashes and 15% of injury crashes in 2018 were reported as distraction-affected crashes.

To address all above issues, the present invention provides a solution to automate food dispensing so that user can eat the food without any distraction caused by eating. The apparatus is easy to carry, easy to hold, easy to store, easy to eat and drink. The system is helpful for drivers/pilots or those who work in critical industrial fields that require full attention. The automatic dispensing of food provides added advantages, such as non-contamination by eating food without touching, food and drink in one container, adding multiple food/drink in one etc.

SUMMARY

In a first aspect of the present invention, a portable apparatus for dispensing food is provided. The apparatus comprising: an external casing having one or more internal container having an outer shell/layer and an inner shell/layer, the internal container is positioned inside the external casing and is removable, said one or more internal container comprises: a food chamber to store a stack of food fritters; a drink chamber to store a beverage; a baseplate in the inner shell/layer of the food chamber to place food fritters; wherein a first spring is placed or attached under the baseplate, the said spring pushes the baseplate upward to align the food fritters towards the opening; a lever/button mechanism to release the food from the apparatus directly toward the user or at an elevation towards a user; a lid to cover the apparatus, the lid is an extension to the external casing.

The first spring in the apparatus connects the base plate with the base of the food chamber, such that when the stack of food fritters are loaded, it compresses the first spring to store the potential energy. When the lever/button is pressed, the first spring decompresses to push the food fritters towards the user.

The one end of the first spring is connected to the baseplate and the second end of the first spring is connected to the top of the apparatus, such that when the stack of food fritters are loaded on the baseplate, the first spring get elongated to store the potential energy. When the lever/button is pressed, the first spring decompresses to push the food fritters towards the user.

The apparatus may comprise the lever/button in shape of a slider, the slider when pressed opens the opening of food chamber to release the food fritters towards the user.

The apparatus may comprise the lever in shape of a button which on pushing activates the first spring and opens the opening of food chamber to release the food fritters towards the user.

The apparatus may comprise the lever in shape of a rotatable lever that rotates around the horizontal axis of the top cover and on rotation activates the first spring to release the food fritters towards the user.

The apparatus may comprise the lever in shape of a straight horizontal lever that rotates around the horizontal axis of the top cover and on rotation activates the first spring, the lever releases the food fritters towards the user and the first spring retract the lever in original position.

The food chamber of the apparatus can be loaded instantly through top loading, wherein the vertical food stack patties are loaded through opening of top lid.

The food chamber of the apparatus can be loaded instantly through vertical or horizontal opening via a hinge, wherein the food container is opened through the hinge and the stack of food fritters are loaded through the opening.

The food chamber of the apparatus can be loaded instantly through vertical opening through rotatable cover, wherein a cover of the food chamber is opened by rotating the cover clockwise or anti-clockwise and the food fritters are loaded in the food chamber.

The food chamber of the apparatus can be loaded instantly through vertical collapsing wherein a hinge at the bottom of the chamber is pulled down to load the food fritters.

The apparatus further comprises a lock and skid mechanism to reduce spring tension and friction on food fritters when the lever/button is pressed. When the lever/button is pressed to push the top food fritter towards a user, a second lever holds the rest of food fritters to reduce the friction on the food fritter being released.

The apparatus further comprises a spring tension adjustment screw to adjust tension in the first spring according to the type of food loaded in the food chamber. In some models tension adjustment screw can also located at the side of the food chamber. The apparatus further comprises a bottom cover to cover the base of the apparatus, said bottom cover comprises a memory card slot, a rechargeable battery. The apparatus further comprises a display screen for displaying an advertisement and to play the users own content from Mobile phone or Laptop as a temporary instant screen, a speaker and a Bluetooth adapter.

In a second aspect of the present invention, a portable apparatus for dispensing food, said apparatus comprising: an external case comprising: a food chamber to store a stack of food fritters; a drink chamber to store a beverage; a baseplate in the food chamber to place food fritters; wherein a first spring is placed or attached under the baseplate, the said spring pushes the baseplate upward to release the food fritters; a lever/button mechanism to release the food from the apparatus directly toward the user or at an elevation towards a user; a lid to cover the apparatus, the lid is an extension to the external casing.

The first spring in the apparatus connects the base plate with the base of the food chamber, such that when the stack of food fritters are loaded, it compresses the first spring to store the potential energy. When the lever/button is pressed, the first spring decompresses and when the food is released towards the user by the lever, the first spring pushes the rest of food fritter upward to align with the opening.

The one end of the first spring is connected to the baseplate and the second end of the first spring is connected to the top of the apparatus, such that when the stack of food fritters are loaded on the baseplate, the first spring get elongated to store the potential energy. When the lever/button is pressed, the first spring decompresses to push the food fritters towards the user.

The apparatus may comprise the lever/button in shape of a slider, the slider when pressed opens the opening of food chamber to release the food fritters towards the user.

The apparatus may comprise the lever in shape of a button which on pushing activates the first spring and opens the opening of food chamber to release the food fritters towards the user.

The apparatus may comprise the lever in shape of a rotatable lever that rotates around the horizontal axis of the top cover and on rotation activates the first spring to release the food fritters towards the user.

The apparatus may comprise the lever in shape of a straight horizontal lever that rotates around the horizontal axis of the top cover and on rotation activates the first spring to release the food fritters towards the user.

The apparatus further comprises a lock and skid mechanism to reduce spring tension and friction on food fritters when the lever/button is pressed. When the lever/button is pressed to push the top food fritter towards a user, a second lever holds the rest of food fritters to reduce the friction on the food fritter being released.

In a third aspect of the present invention, a portable modular apparatus for dispensing food is provided. The apparatus comprising: a food chamber module to store a stack of food fritters; a drink chamber module to store a beverage; wherein the food chamber module comprises a baseplate in the food chamber to place food fritters; wherein a first spring is attached to the baseplate, the said spring pushes the baseplate upward to release the food fritters; a lever/button mechanism to release the food from the apparatus directly toward the user or at an elevation towards a user; a lid to cover the apparatus, the lid is an extension to the external casing.

The apparatus may comprise the lever/button in shape of a slider, the slider when pressed opens the opening of food chamber to release the food fritters towards the user.

The apparatus may comprise the lever in shape of a button which on pushing activates the first spring and opens the opening of food chamber to release the food fritters towards the user.

The apparatus may comprise the lever in shape of a rotatable lever that rotates around the horizontal axis of the top cover and on rotation activates the first spring to release the food fritters towards the user.

The apparatus may comprise the lever in shape of a straight horizontal lever that rotates around the horizontal axis of the top cover and on rotation activates the first spring to release the food fritters towards the user.

The food chamber of the apparatus can be loaded instantly through top loading, wherein the vertical food stack patties are loaded through opening of top lid.

The food chamber of the apparatus can be loaded instantly through vertical or horizontal opening via a hinge, wherein the food container is opened through the hinge and the stack of food fritters are loaded through the opening.

The food chamber of the apparatus can be loaded instantly through vertical opening through rotatable cover, wherein a cover of the food chamber is opened by rotating the cover clockwise or anti-clockwise and the food fritters are loaded in the food chamber.

The food chamber of the apparatus can be loaded instantly through vertical collapsing wherein a hinge at the bottom of the chamber is pulled down to load the food fritters.

The apparatus further comprises a spring tension adjustment screw to adjust tension in the first spring according to the type of food loaded in the food chamber.

In the apparatus the user can load food fritters into food chamber module and attach to the spring module through magnetic fit, snap fit or through hinge mechanism.

Alternatively the user can load drink package into the drink container module and attach to the spring module through magnetic fit, snap fit or through hinge mechanism.

BRIEF DESCRIPTION OF DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings.

DETAILED DESCRIPTION

Figure 1:
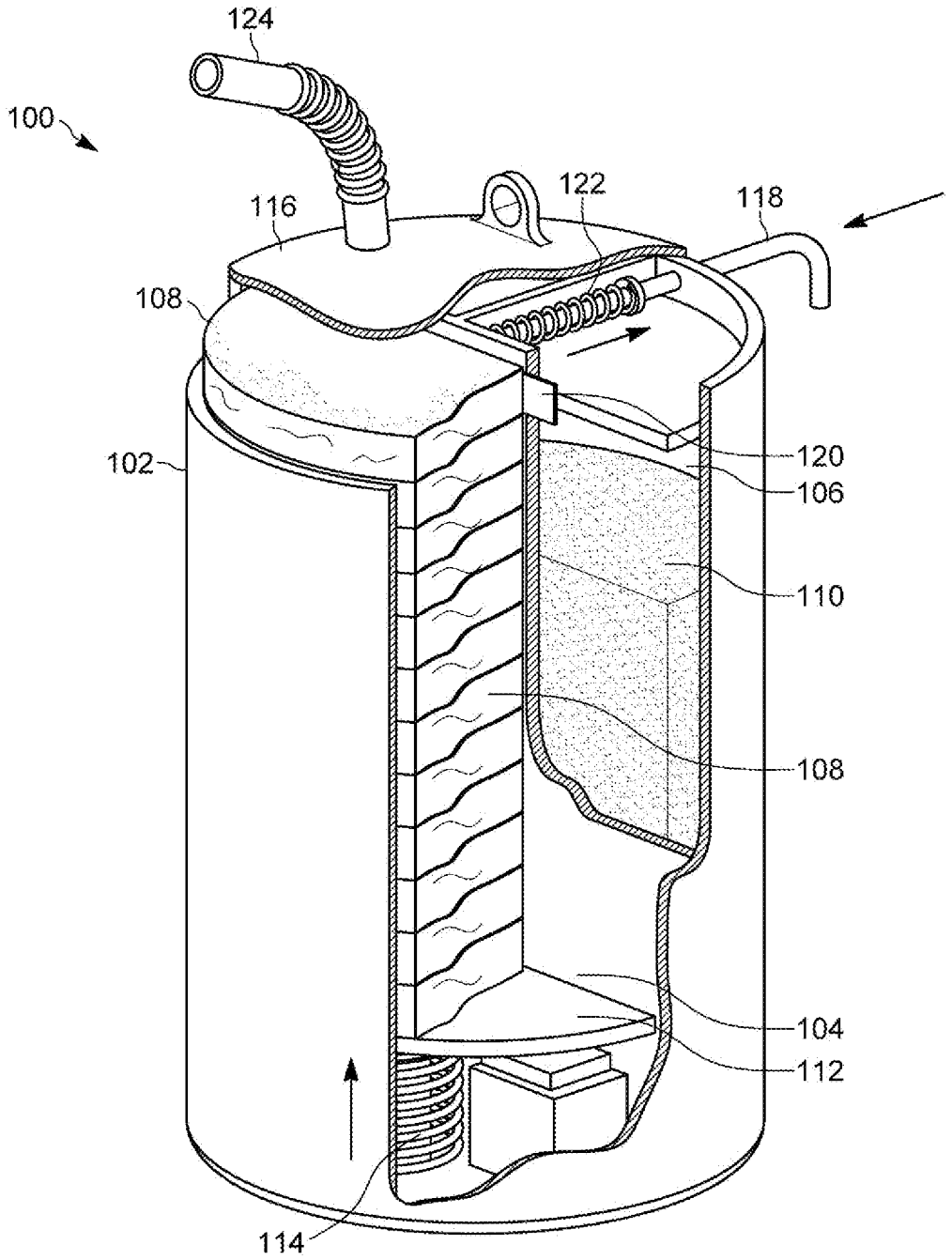
FIG. 1 illustrates a partial sectional perspective view of an apparatus for dispensing food and drink to a user in accordance with an embodiment of the present invention.

In the following detailed description of embodiments of the invention, numerous specific details are set forth in order to provide a thorough understanding of the embodiments of invention. However, it will be obvious to a person skilled in art that the embodiments of invention may be practiced with or without these specific details. In other instances, well known methods, procedures and components have not been described in detail, so as not to unnecessarily obscure aspects of the embodiments of the invention.

The terminology used herein is for the purpose of describing particular embodiments only and is not intended to be limiting of the invention. As used herein, the term "and/or" includes any and all combinations of one or more of the associated listed items. As used herein, the singular forms "a", "an", and "the" are intended to include the plural forms as well as the singular forms, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In an embodiment of present invention, a portable hand-held apparatus for dispensing food is provided. The apparatus comprising: an external casing and an internal container having an outer shell/layer and an inner shell/layer. The internal container is placed inside the external casing. The internal container can be removed to fill the food cartridge. The internal container has a baseplate in the inner shell/layer of the internal container to place food fritters, patties. A spring is connected to the baseplate with the inner shell/layer of the internal container. A handle is provided on the external casing to hold the apparatus comfortably. The handle is provided with a lever. The apparatus has a lid to cover the apparatus, wherein the lid is an extension to the external casing. The lid prevents the food stored inside the food chamber from exposure to the external environment to prevent decay of food. The lever provided in the handle when pressed, the first spring pushes the food fritters or patties to pop it towards the user. The lever provided in the handle can be any user convenient shape, such as lever can be straight or bend like a reverse L-shape, or T-shape button or a spring button, so that the user can hold the apparatus comfortably and lever can easily be pushed or pressed. In some embodiment, the lever can be in shape of button that when pushed activates the spring. The lid of the apparatus may have a second spring attached to it that connects with the lever. When the lever is pressed, the second spring open the lid and pushes the food towards the user.

The external casing and internal container of the apparatus can be preferably made of transparent material to view the inside content or it can be made of opaque material. The material such as plastic, glass, light metal like aluminum or tin can be used for external casing and the internal container.

The food is sliced into small round circular or semi-circular patties preferably if the system is round shape, and it also can be made into any shape, for example square type, and patties are looks like middle of burger round cooked Pattie size. The food can be processed food or raw food.

This apparatus has external casing, and inside the external casing, food is placed into small round internal container. Either it's hollow with supporting 3 or more spokes or vertically supporting pillar type The base of the internal container has spring, when food is placed on top of the spring, compressed spring stores elastic potential energy, and when spring expands it is released as kinetic energy.

The apparatus can be hold like a coffee cup with handle and lid, so there is a hand button or lever type mechanism near thumb. When the lever is pressed, it releases incrementally one Pattie at a time towards upward and at same time above container lid will open automatically. The lid prevents the food stored inside the food chamber from exposure to the external environment to prevent decay of food.

When button or lever is pressed or pulled, top of the container lid will open, and at the same time, the compressed spring stores elastic potential energy released as kinetic energy when it expands. Kinetic energy in spring releases and pushed Pattie or patties to upward, and top of the food circular/cylindrical Pattie will be freed and pop up when the container lid opens upward, so that user can pick through mouth without touching food.

In some embodiment, there is spring loaded at the hand lever to push the patty directly pointing towards user mouth to eat.

Pressing the lever down or towards container handle can release one Pattie at a time, and then once close the lid by pressing lever upwards or away from container handle so that spring loaded mechanism will be active for subsequent release or next release.

In another embodiment of present invention, a portable hand-held apparatus for dispensing food fritters and a beverage is provided. The apparatus comprises two chambers placed in an external casing. The first chamber is the food chamber that is used to store food item that need to be dispensed. The food item can be in form of patties, fritters, cake, cutlet, croquettes etc. The second chamber is the drink chamber that stores a beverage for drink. The external casing has a lid to cover the top. The lid prevents the food stored inside the food chamber from exposure to the external environment to prevent decay of food. The first chamber and the second chamber are separate or are joined together through a screw or magnet in a vertical direction.

In the apparatus, the food chamber can be stacked multiple types of fritters/patties in order to meet nutritional requirement of the body and to avoid boredom of food or repetitive same food.

In an embodiment, the apparatus can be in form of reusable apparatus, wherein the food chamber and the drink chamber can be refiled or it can be a disposable apparatus. In case of disposable apparatus, the food container and the drink container are in-built by providing provisions for different chamber in the external casing.

Figure 2:
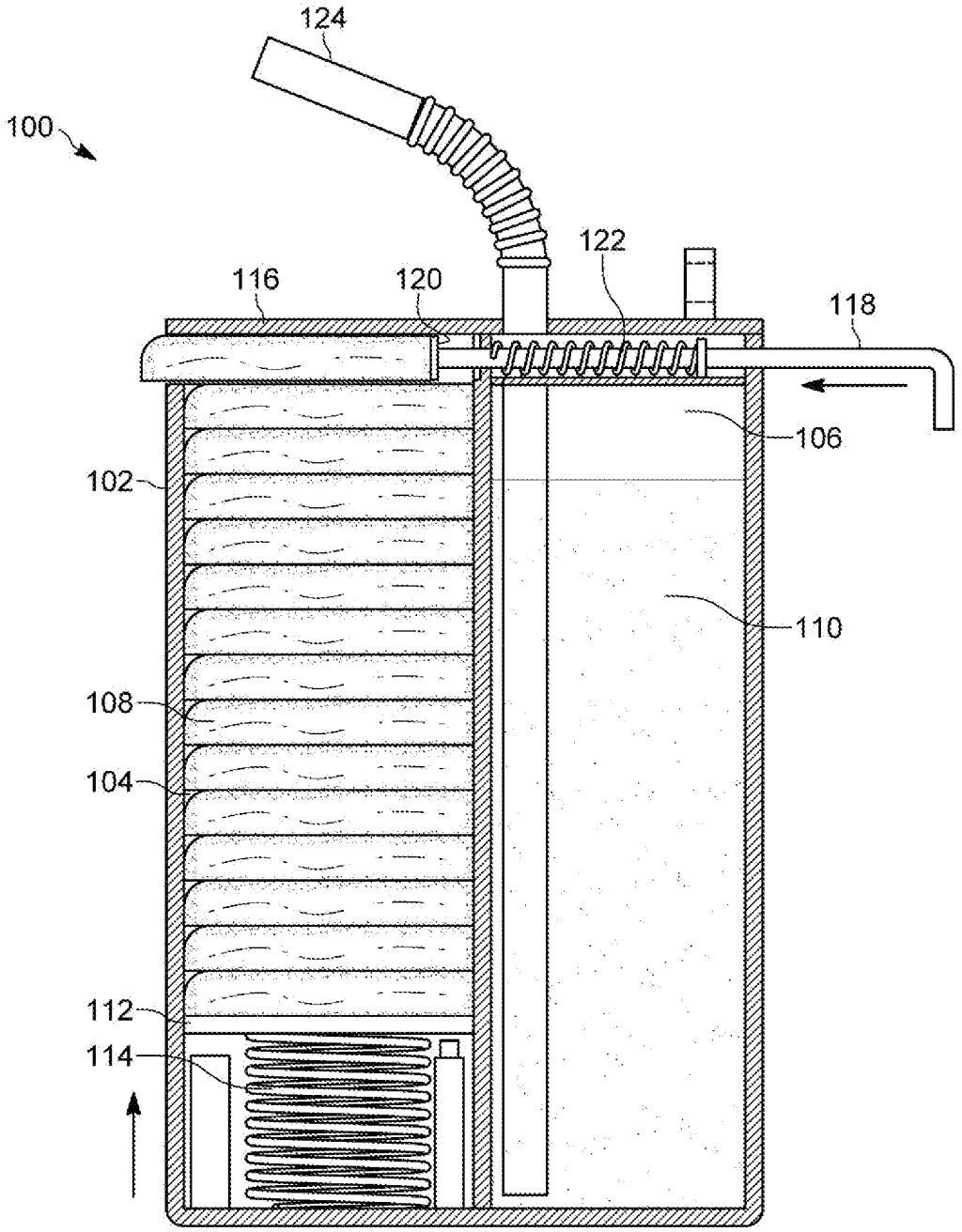
FIG. 2 illustrates a partial sectional view of an apparatus for dispensing food and drink to a user in accordance with an embodiment of present invention.

FIG. 1 and FIG. 2 illustrates partial sectional perspective view and partial sectional view of the apparatus. Referring to FIG. 1 and FIG. 2, the apparatus 100 comprises an external case 102 that provide housing for accommodating a food chamber 104 and a drink chamber 106 that are placed inside the case and are separated with each other. The food chamber 104 and the drink chamber 106 can be taken out and refilled with a food content 108 and drink/beverage 110. The food chamber 104 has a base plate 112 on which food 108 are stacked over each other. The bottom of the external case 102 has a first spring 114 over which the baseplate 112 of the food chamber 104 is placed. The first spring 114 is in pressed state to store the potential energy, such that when the first spring 114 is released it moves in the upward direction to move the food items 108 towards the top of the apparatus. The apparatus 100 has a lid 116 on the top of the apparatus 100 to cover the external case 102 at top. A lever 118 is connected to a plate 120 at the top of the food chamber 104. The lever 118 has a second spring 122 in relaxed form, such that when the lever is manually pushed or pulled, the second spring 122 exerts a force on the plate 120 to push the food stack outside towards a user through an opening provided on the external case 102. The opening on the external cased can be sealed with a protective sticker or film to protect food from being exposed to outer environment. The user has to remove the sticker or film before using the apparatus to pop food out. A flexible straw lid 124 is provided on the top of the apparatus 100 that extends and runs into the drink chamber 106. The flexible straw lid 124 can be retracted back when not in use and extended when a user wants to drink from the apparatus. Using the flexible straw lid 124, the user is able to drink the content stored in the drink chamber 106. The apparatus further comprises electronic circuitry as a combined or separate attachment module, such as battery, circuit board etc. inside the external casing to drive any electronic component of the apparatus 100. The apparatus 100 in addition may comprises a display screen for advertisement or displaying information on food content.

Figure 3:
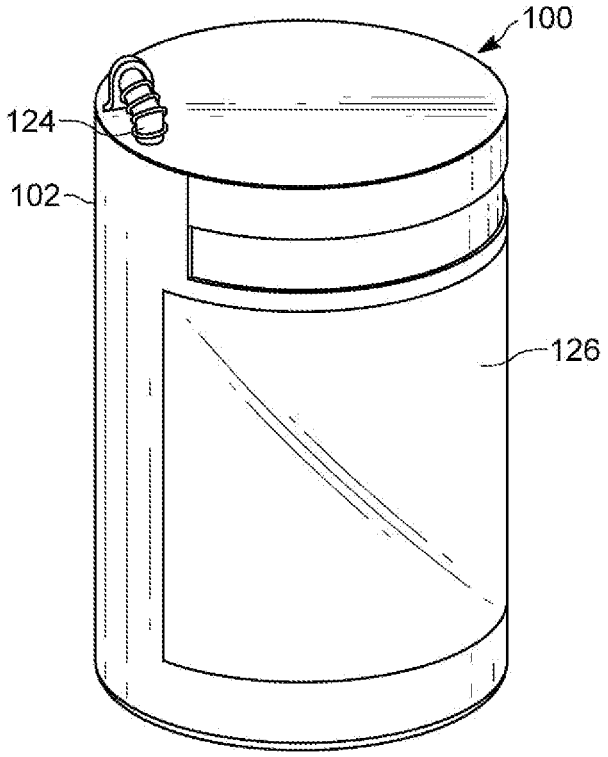
FIG. 3 illustrates a perspective view of the apparatus in closed state in accordance with an embodiment of present invention.
Figure 4:
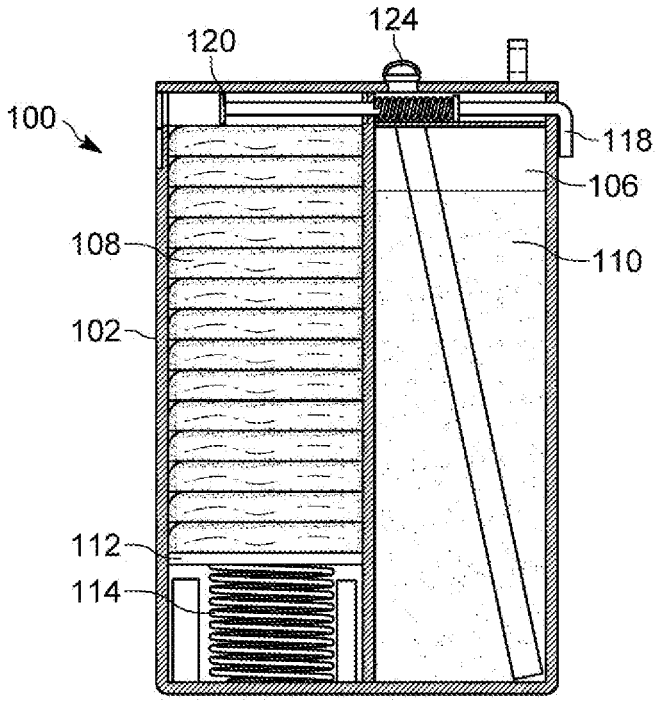
FIG. 4 illustrates a section view of the apparatus in closed state in accordance with an embodiment of present invention.

FIG. 3 illustrates perspective view and FIG. 4 illustrates section view of device in closed position. Referring to FIG. 3 and FIG. 4, the screen 126 on the external case 102 can be used to display advertisements. The flexible straw lid 124 is in expanded state in FIG. 3 and in retracted state in FIG. 4. The food 108 are stacked over each other in the food chamber 104. The baseplate 112 of the food chamber 104 is placed over the first spring 114 at the bottom of the apparatus. The lever 118 is in relaxed state. When the lever 118 is pushed/pulled the second spring 122 in lever pops the lid/cover/slider 116 of the apparatus 100 open, which will release the tension stored in first spring 114 at the base of the apparatus. The first spring 114 pushes the food upward and the plate 120 at the top of the food chamber 104 pushes the food outwards towards a user. The flexible straw lid 124 extends inside the drink chamber 106. The flexible straw 124 is inserted into a straw holder. The straw holder can be used as connecting retractable spring wire that can be used to pull the apparatus easily to eat and drink especially during driving or easy to pick. The straw holder is used to keep the flexible straw 124 horizontally so that the drink does not get spilled. Whenever a user wants to feed or drink, the user can pull the flexible straw form the straw holder and once the drink is finished, the flexible straw 124 can be inserted back into the straw holder.

Figure 5:
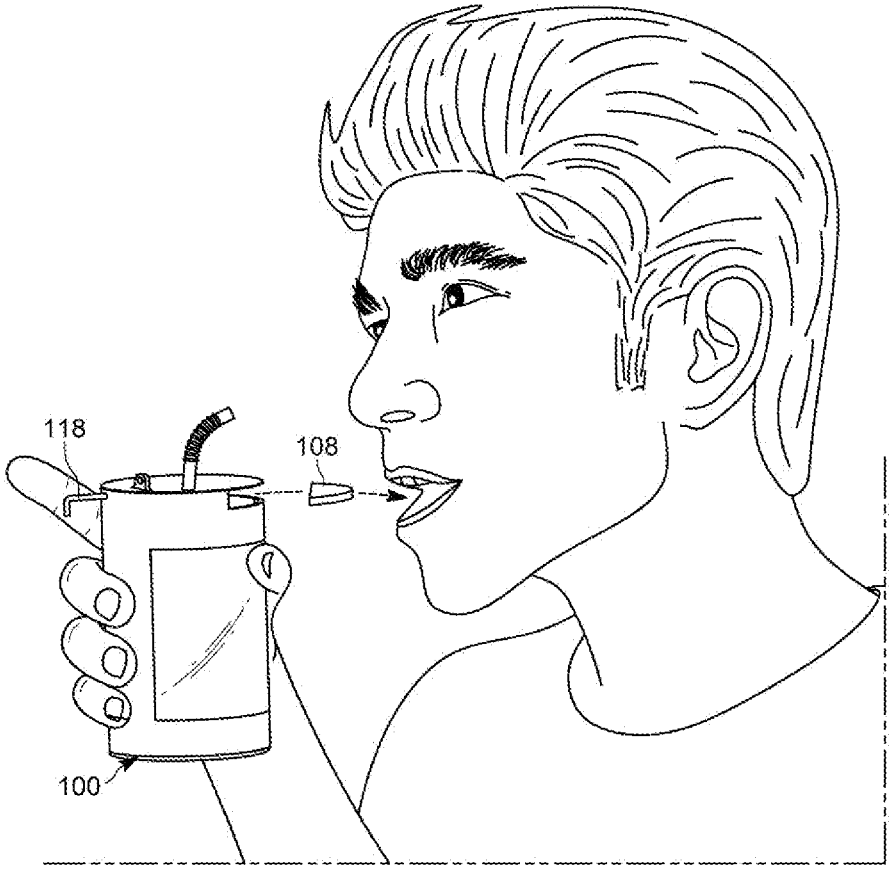
FIG. 5 illustrates the apparatus dispensing food towards a user in accordance with an embodiment of present invention.
Figure 6:
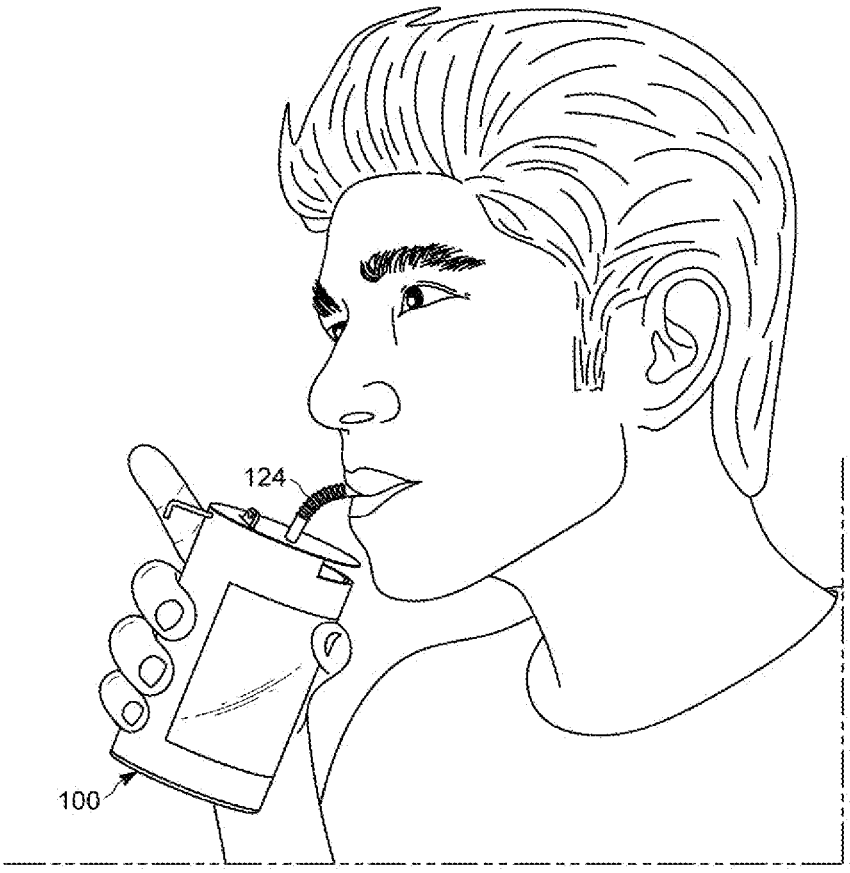
FIG. 6 illustrates a user using the apparatus for drinking beverage in accordance with an embodiment of present invention.

Referring to FIG. 5, the user push/pull the lever 118 and the food fritter or patties is pushed towards the mouth of the user. Referring to FIG. 6, the user pulls out the flexible straw lid 124 and is able to drink the beverage stored in the drink chamber.

In an embodiment of present invention, the apparatus can be in shape of cylindrical, rectangular, cubical, and polygonal or any other geometrical shape. The apparatus has a handle to hold the apparatus comfortably by the user. A lever is provided in the handle of the apparatus. The lid is placed at the top of the container, where the user can open it upwardly by pressing a lever.

The food chamber holds staked food items in the form of patties, cakes, or sushi. The apparatus includes a food eject mechanism to push or eject the food from the food chamber. The food eject mechanism can be a spring-loaded based mechanism or a non-spring-loaded based mechanism.

The spring-loaded mechanism utilizes two springs. The first spring is placed at the bottom of the first chamber, i.e., food chamber, below the staked food to push the food in an upward direction. The second spring is located below the lid to push or eject the food towards the user through the lever.

In the non-spring-loaded mechanism, the staked food is placed on top of a baseplate in the first container. The baseplate is connected to the lever or handle. When a user presses the lever, the food is pushed upward towards the opening provided in the apparatus through the slide mechanism. The lever lifts the baseplate upward such that the staked food on the baseplate movers upward towards the opening on the apparatus.

Figure 7:
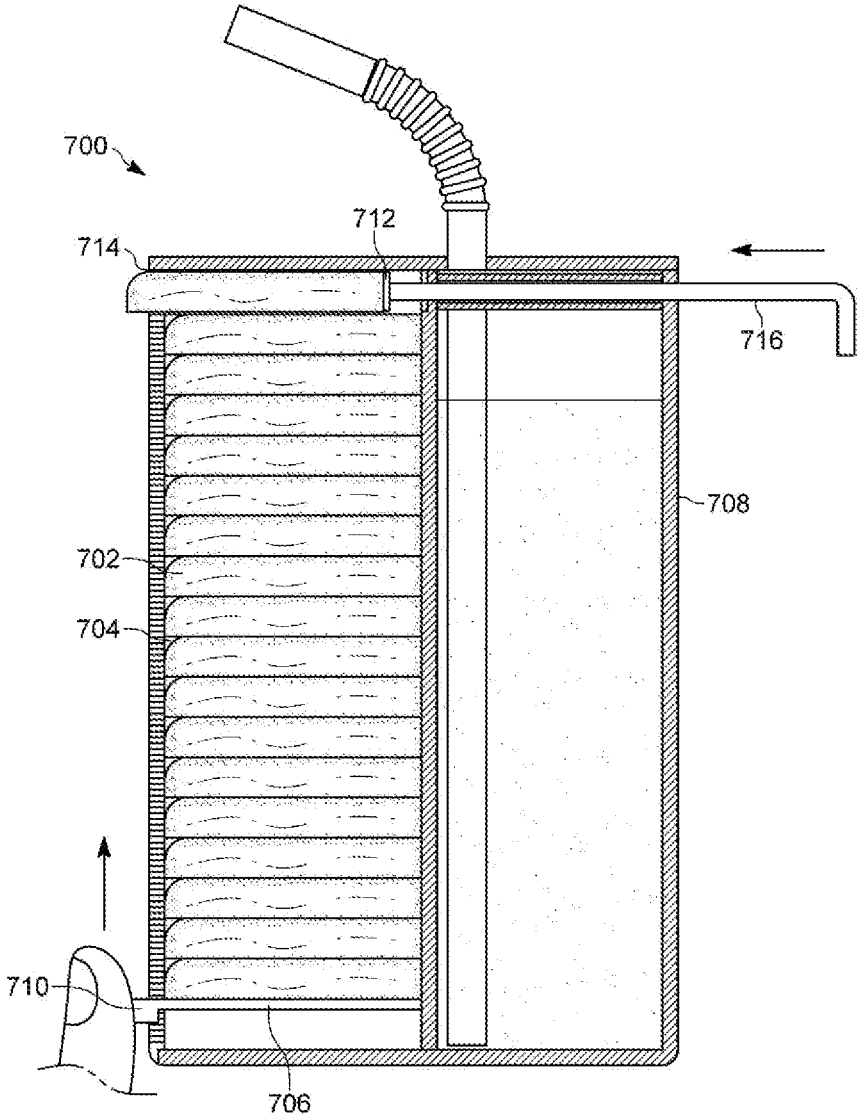
FIG. 7 illustrates a partial sectional view showing an apparatus with manual mechanism for dispensing food and drink in accordance with an embodiment of present invention.

FIG. 7 shows a partial sectional view of the apparatus that works on manual mechanism in accordance with an alternative embodiment of present invention. The food 702 is stored in the food chamber 704 of the apparatus 700. The base plate 706 has food 702 stacked over, the base plate is extended outwards the external casing 708 and a handle 710 is provided at the outer edge. The base plate 706 can be pushed upward through the slit provided on the external casing 708. At the top of the food chamber 706, a plate 712 is provided opposite to an opening 714 for letting the food out. The plate 712 is connected to a lever 716. The lever 716 can be a spring loaded or non-spring loaded handle or a button. When the lever or button 716 is pushed or pressed, the lever 716 moves the plate 712 towards the opening 714 and pushes the food 702 towards outside. Once one of the stack of food 702 is release, the handle 710 is used to move the base plate 706 upward to position the next food stack for release.

The staked food can be released in two ways. In the first type, the staked food is directly released from the top of the apparatus. In this method, the lever is connected to the lid and when the lever is pressed it opens the lid to release the staked food. In second type, the apparatus has a horizontal slit hole with a size of slightly bigger than Pattie or fritter size at the front of the external casing opposite to the lever. When the user presses the lever button, the slit hole gets opened to release the staked food. Both the food releasing methods can be used either alone or jointly depending on the embodiments.

In an embodiment of present invention, the food container and the drink container are separate or joined. The fixing of the food container and the drink container is carried out by any fix mechanism, such as screw fix or magnet type quick fix or fix through slot and turn to sit firmly.

Figure 8:
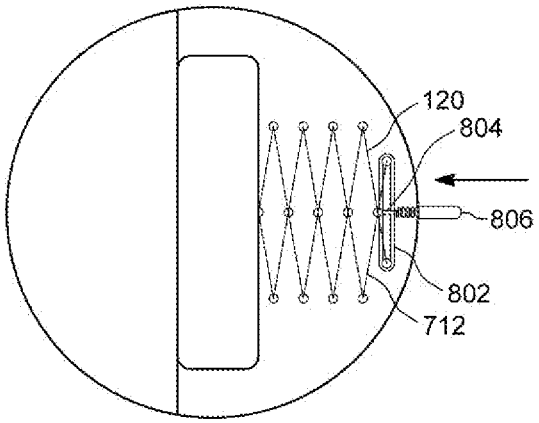
FIGS. 8 and 9 illustrates an apparatus using alternate method for popping food towards a user in accordance with an alternate embodiment of present invention.
Figure 9:
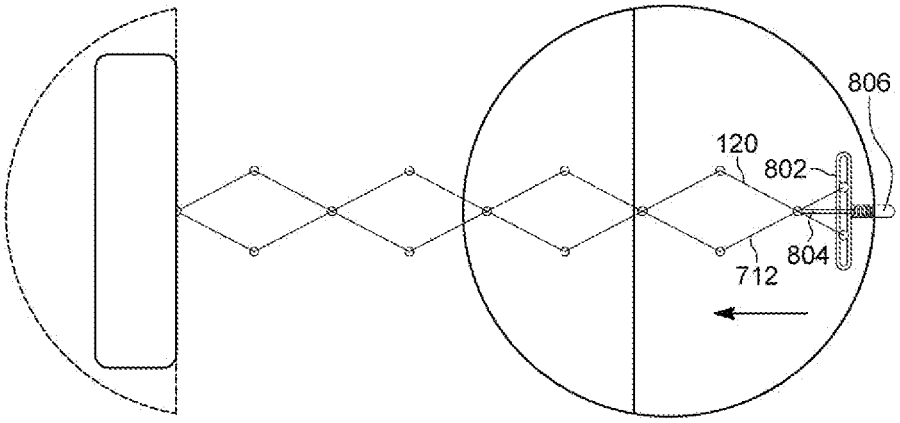

Referring to FIGS. 8 and 9 that illustrates a spring mechanism to pop the food outside towards a user. The plate (120, 712) is connected to a stationary slotted link 802 at the top of apparatus through a jack link 804. The stationary slotted link 802 is connected to a spring enable lever or button 806. The food stack stored in the food chamber is held against the wall of the plate (120, 712). The spring of the lever in retract position keeps the apparatus in closed position. When the lever or button 806 is pushed/pulled/pressed, the spring pushes the stationary slotted link 802 to expand the jack links 804, that forces the food stack outside and pop the food toward user.

Figure 10:
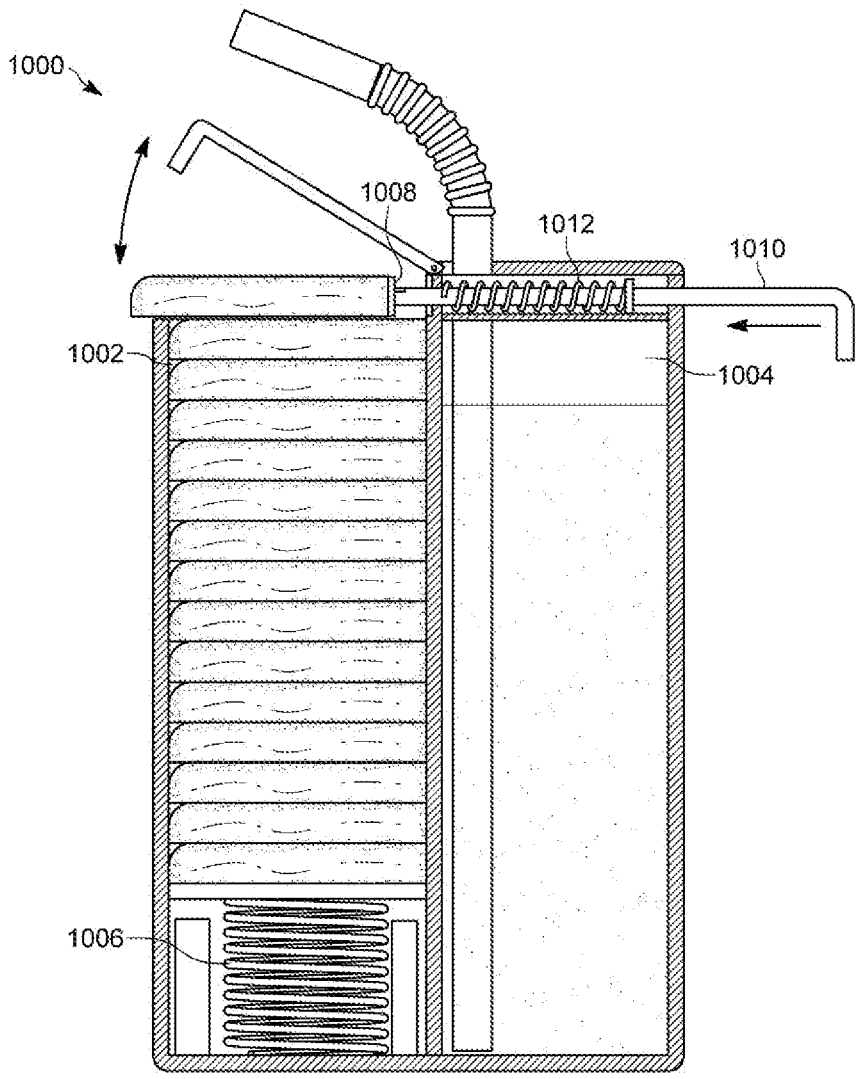
FIG. 10 illustrates the apparatus showing working of a lever mechanism in accordance with another embodiment of the present invention.

FIG. 10 illustrates the apparatus showing working of a lever mechanism in accordance with another embodiment of the present invention. The apparatus 1000 comprises a food chamber 1002, a drink chamber 1004. The food is stacked over the based plate inside the food chamber. The baseplate is placed over a first spring 1006. The food chamber 1002 has a lid at the top. The lid prevents the food stored inside the food chamber from exposure to the external environment to prevent decay of food. The top of the food chamber has a plate 1008 connected to a lever 1010. The lever 1010 has a second spring 1012 that is connected to the lid of the apparatus. When the lever 1010 is pressed, the second spring 1012 connected to the lid, opens the lid to provide passage to pop-out food and the plate 1008 pop the food outside towards the user. The food is popped up at an angle in upward direction towards the user. The lever 1010 opens the lid at an angle ranging from 20 degree to 90 degrees that allow the popping up of food at a varying angle from 30 degree to 90 degree. For refilling the food chamber, the first spring 1006 at the baseplate can be positioned in lock state, so that when the lid is opened to refill the food chamber, the first spring 1006 at the baseplate do not push patties/fritter upside and crush to the top lid.

Figure 11:
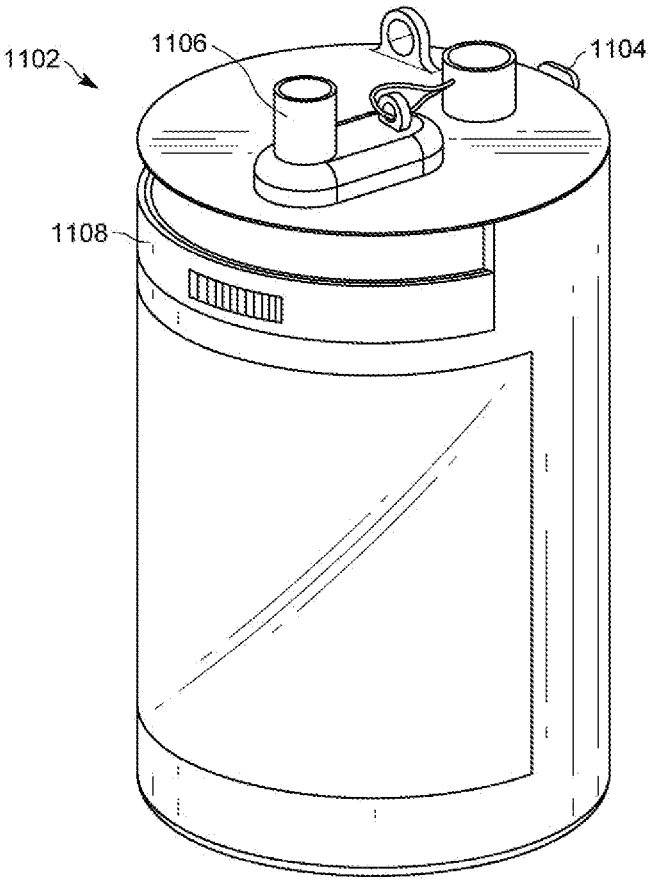
FIG. 11 illustrate and apparatus with a lid and a push button as a lever for releasing food to a user in accordance with another embodiment of the present invention.

FIG. 11 illustrates the apparatus with push button in place of lever in accordance with another embodiment of the present invention. The apparatus 1102 has a screen to display the advertisement or product information. At the top of the apparatus 1102, a push button 1104 is present. The push button 1104 serves the function similar to a lever. The top of lid is extruded outside to provide a circular tip 1106 that extends inside the drink chamber. The user is able to drink the beverage stored in the drink chamber through the circular tip 1106. When the push button 1104 is pressed, the lid/cover 1108 slide up and open the opening in the apparatus from where the food pop out towards the user.

Figure 12:
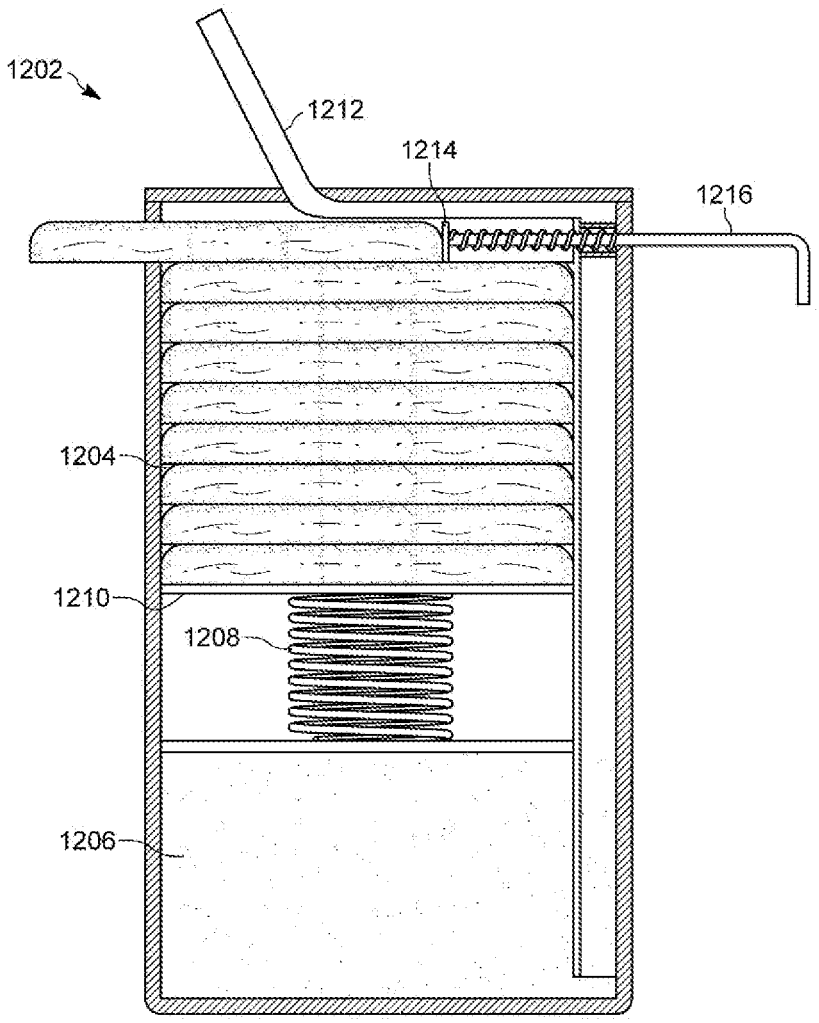
FIG. 12 illustrates a food and drink dispensing apparatus with a food container and a drink container stacked vertically in accordance with another embodiment of present invention.

FIG. 12 illustrates the food and drink dispensing apparatus with a food chamber and a drink chamber separated vertically in accordance with another embodiment of present invention. The apparatus 1202 comprises a food chamber 1204 and a drink chamber 1206 positioned vertically above each other. In the given figure, the drink chamber 1206 is at the bottom of the apparatus 1202. A spring 1208 is placed at the top of the drink chamber 1206. The food chamber 1204 has a baseplate 1210 on which food are stacked. The apparatus is covered with a lid. A flexible straw 1212 is extended from the drink chamber 1206 towards the top of the apparatus 1202. A plate 1214 is provided at the top of the food chamber 1204 that is movable along the horizontal axis through a spring connected lever 1216. When the lever 1216 is pressed, the plate 1214 moves horizontally and release the food stack outside through an opening provided in the food chamber 1204. The flexible straw shown in FIG. 12 is bend horizontally up, however, alternatively it can be in straight position without any bend.

Figure 13:
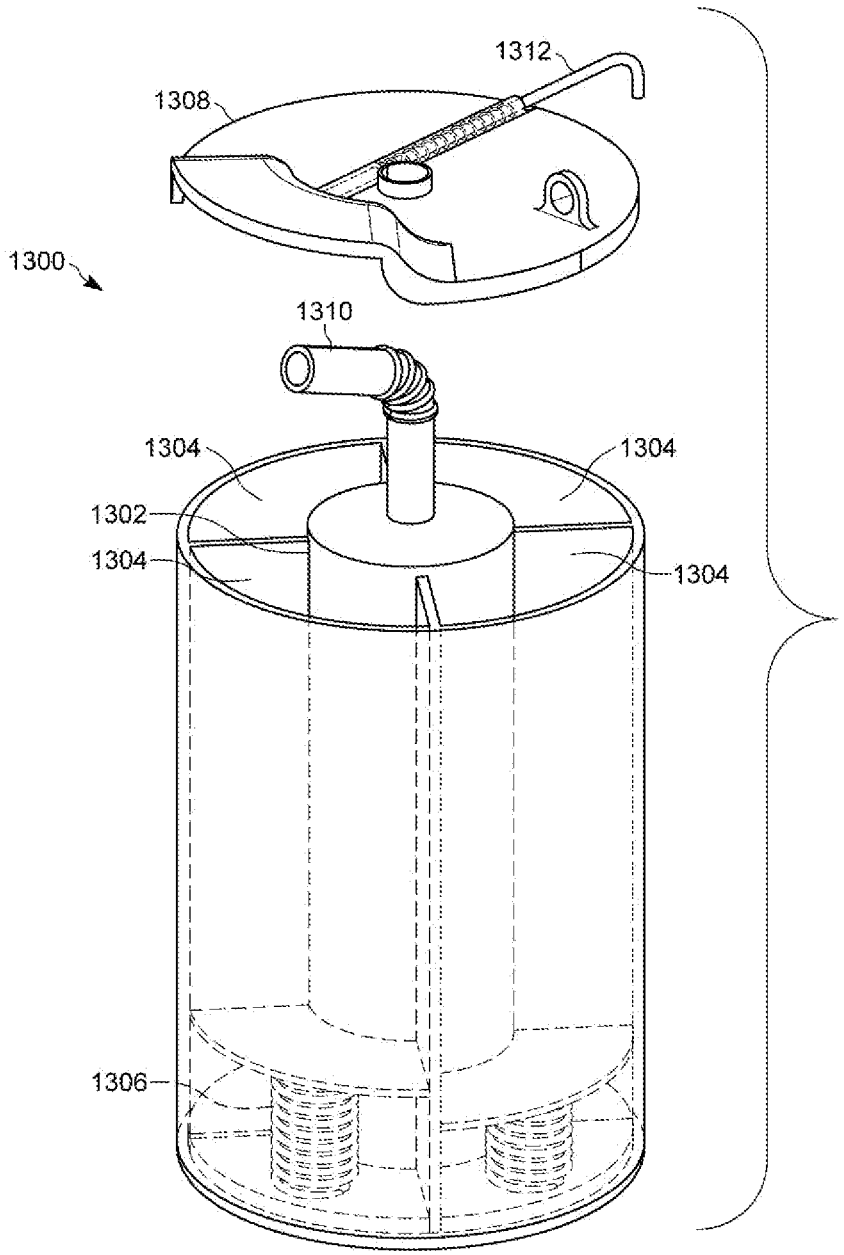
FIG. 13 illustrates an exploding view of an apparatus having multiple chambers in accordance with another embodiment of present invention.
Figure 14:
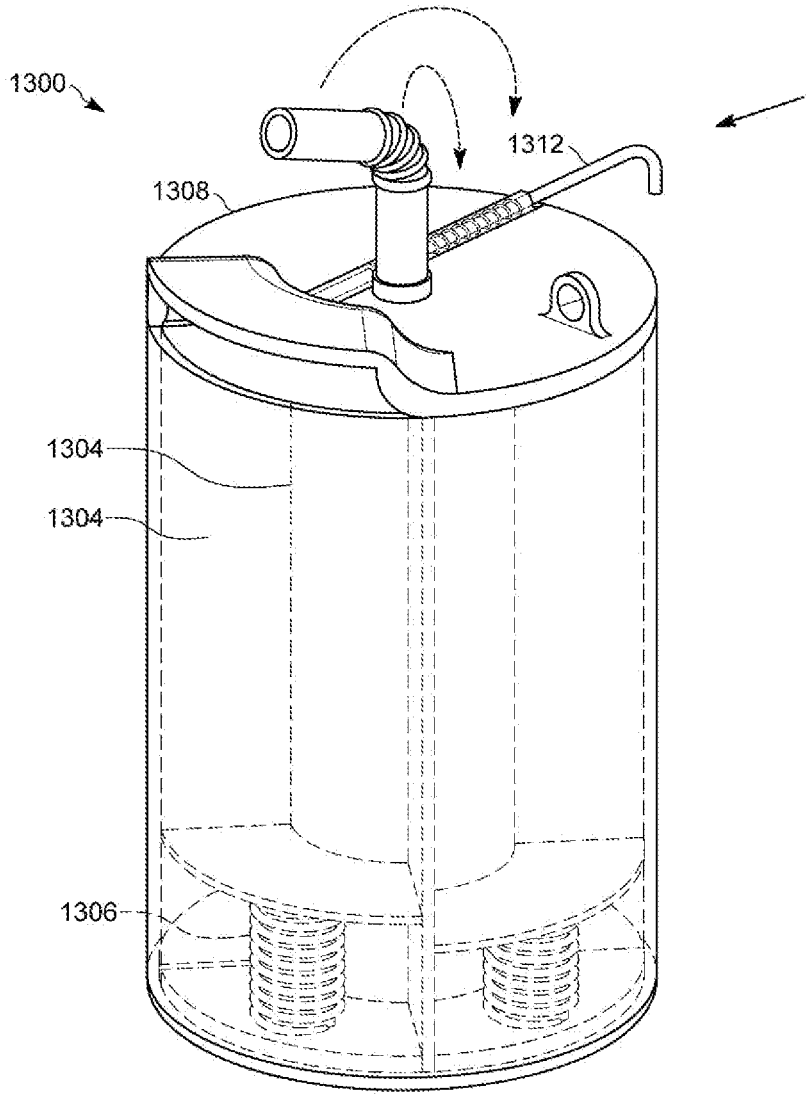
FIG. 14 illustrates a perspective view of the apparatus having multiple chambers in accordance with another embodiment of present invention.

Referring to FIGS. 13 and 14, an apparatus comprising multiple food chambers and a drink chamber is provided. The apparatus comprises a drink chamber 1302 positioned in the center of the apparatus 1300. The space outer to the drink chamber is segregated into a plurality of food chambers 1304. The plurality of food chambers 1304 allows to store different food type in different chambers. Each of the plurality of food chambers 1304 are provided with a spring 1306 at the base plate that connects to the bottom of the apparatus 1300. The apparatus 1300 has a lid 1308 that covers the top of the apparatus. The lid 1308 has a circular opening in the center to allow a flexible straw lid 1310 to pass through. The lid 1308 provides an opening for food to pass through outside. A spring lever 1312 with a plate is provided on the lid. The lid 1308 is rotatable so as to position the plate connected to the lever in desired food chamber. The lever can be pressed or pulled to slide the food from the desired food chamber outside. The lid cover of the apparatus is screw type so that the lid opening for the food can be turned left and right to push the food from the desired food chamber to the user. At a given time, the user can pop the fritters from one chamber only. The user can turn the screw left or right to push the food from desired container.

In an embodiment of present invention, the apparatus comprises multiple food chamber and multiple drink chambers arranged in any possible configuration to provide user an option with multiple food and multiple drinks.

In an embodiment of present invention, the lever of the apparatus for dispensing food and drinks can be provided as a separate accessory instead of providing it as in-built unit to the apparatus. The lever can be provided as an attachment with a plastic string to the apparatus or by sticking with sticker. The user has to simply screw the lever into the holes behind the spring before pressing. Providing lever as an attachment is useful in avoiding packaging and other issues due to lengthy lever.

Figure 15:
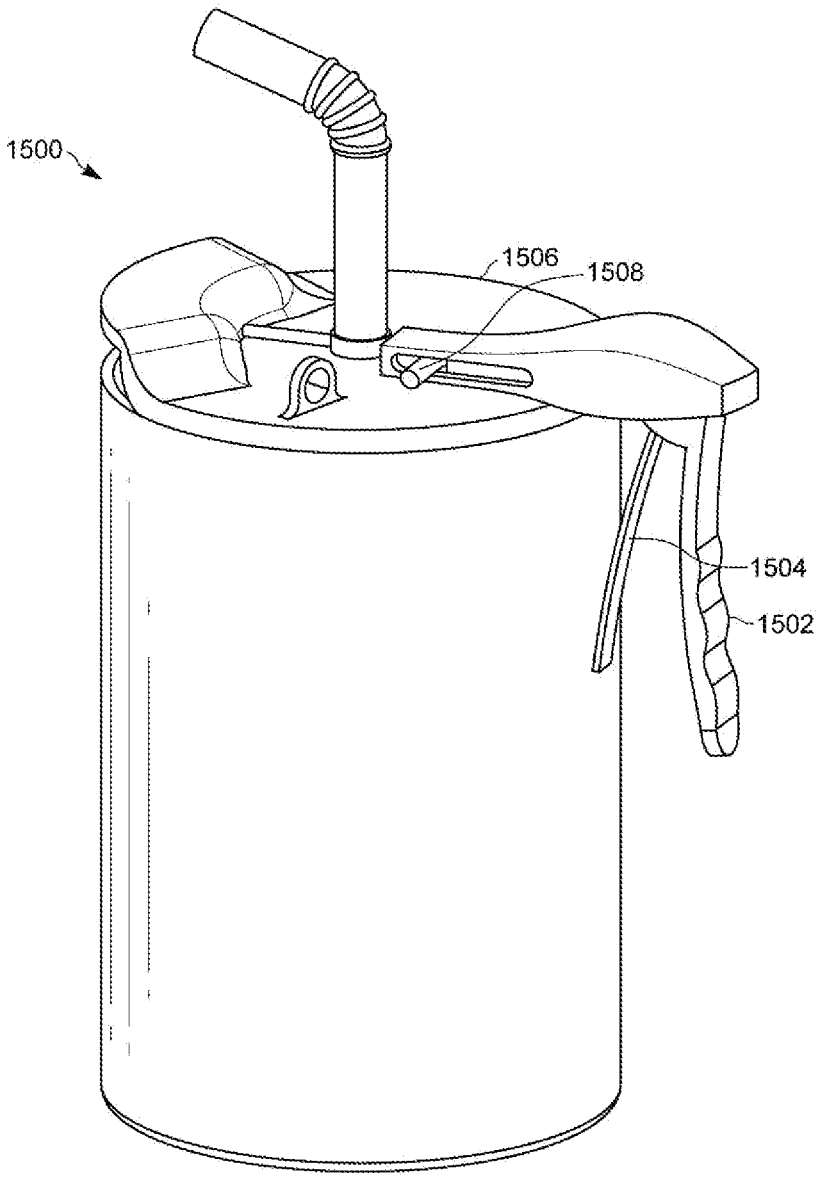
FIG. 15 illustrates a food dispensing apparatus with a trigger mechanism to release the food in accordance with another embodiment of present invention.

FIG. 15 illustrates a food dispensing apparatus with a trigger mechanism to release the food in accordance with another embodiment of present invention. Referring to FIG. 15, the apparatus 1500 has a trigger mechanism to release the food fritters/patties. The trigger mechanism comprises a handle 1502 with a trigger 1504. The handle 1502 may be attached to the lid 1506 of the apparatus or on the wall of the apparatus. For the apparatus having plurality of food compartments, the handle 1502 is attached on the lid. When a user wishes to eat the food patty or fritter from a selected compartment, the user can rotate the lid that also rotates the handle 1502 with the trigger 1504 also rotates so that the trigger mechanism can be activated for the selected compartment. For the apparatus with a single compartment of food patties/fritters the lever mechanism does not need to be revolving, therefore, the handle 1502 with the trigger 1504 can be attached to the lid 1506 or on the wall of the apparatus. A small horizontally or vertically slit with small lever 1508 is provided below the handle 1502 on the apparatus. The slit with small lever 1508 is used to operate to push or pull to activate or reload the handle with spring for each trigger operation. The handle 1502 with the trigger 1504 is used to push large size patties. The trigger mechanism is one of the push mechanisms for food dispensing apparatus along with the T-shaped and L-shaped levers, these types can be used in any embodiment.

In another embodiment of present invention, the apparatus has a hole at near to the base which is connected to extendable straw running adjacent to the container having drink. The user can pull the straw and drink the content. The extendable straw is leak proof, easy to open and is located close to the drink and food separator and outer surface. The straw can be a leak proof short straw with closed cap at the tip attached with a plastic string. The straw is flexible to put and extends parallel to the container surface. When needed, user can open straw by pulling it up and open the cap to drink. After drinking, the user can put back the cap to prevent leaking. Alternatively, the straw is a long solid straw with some slight gap at the base to fill the container top lid, which is connected to the extendable straw running adjacent to the container. The user can pull and drink the content and after use, stick back to the container.

In another embodiment, the apparatus contains heating element at the base of the food container. The heating element can be used to heat the food by using external power adaptor. Alternatively heating element can be in form of a grill that surrounds the internal container and heat up the patties/fritters stored inside the internal container uniformly and evenly in a quick time. The provision of two casings or layers (inner and outer layer) enable a user to hold the apparatus comfortably even though the inside food is too hot or cold.

In another embodiment of present invention, the external casing of the apparatus can further be provided with a display screen. The display screen is wrapped around the whole apparatus or over some area of the apparatus. The display screen comprises a memory unit to store program or digital content and is configured to display the digital content (e.g., image, text, video, audio, etc.). The display screen allows the companies to display their food or other advertisements to attract customers or merchandise. The flexible display screen can be reusable or disposable.

In some aspects, the apparatus of present invention can be used as a disposable container that comes with food and drink sealed container and also comes with even single or dual layer. After use, the user can dispose the apparatus.

In other aspects, the apparatus of present invention can be used as a non-disposable container. The user can buy the empty apparatus separately and can buy the food cartridges from shops or resellers. The non-disposable apparatus can be provided with various accessories like portable heating element or adapter to put the container to heat certain level from frozen state. The reseller or shops can provide the food cartridge in form of patty, fritter, croquettes, and cakes or in any other from and shape. The user can buy and fill the non-disposable cartridges in the apparatus. To maintain hygiene and nutrition level, the reseller can mix various foods and snacks. The Food needs to be prepared in solid form to suit this container. Separate Home kits can be developed for preparing food in patty/fritter format. The drink container can be refilled with various options, such as coffee, tea, milk juices etc.

The food patties/fritters can be prepared with holes in them so as to prevent choking in users, when the user try to aim food patties/fritters directly into the mouth.

The present invention provides various technical advantages and economic significance over the conventional technology. The apparatus of the present invention is easy to carry, hold, eat and drink even when the user is mobile. The various food items can be easily stacked in form of patties, fritters, cake, and croquette according to user's interest or to maintain nutritional values for avoiding eating same thing regularly. The content in apparatus is easy to freeze and heat up. The apparatus can be used to dispense food and drink easily without fear of spilling and fragmenting. The transparent container allows a user to see the food content of the apparatus.

The apparatus provides provision to add water, juice, tea, coffee or any other drinks. Furthermore, the apparatus can be used to add processed fruits, vegetables, medicines by processing them into required shape.

The apparatus can easily be sold through vending machines. The apparatus can be a single use apparatus where the used one can be discarded, or it can be reusable that can be used after every cycle. Business eco system can be built, so that readymade patties companies can used the eco system.

Figure 16A:
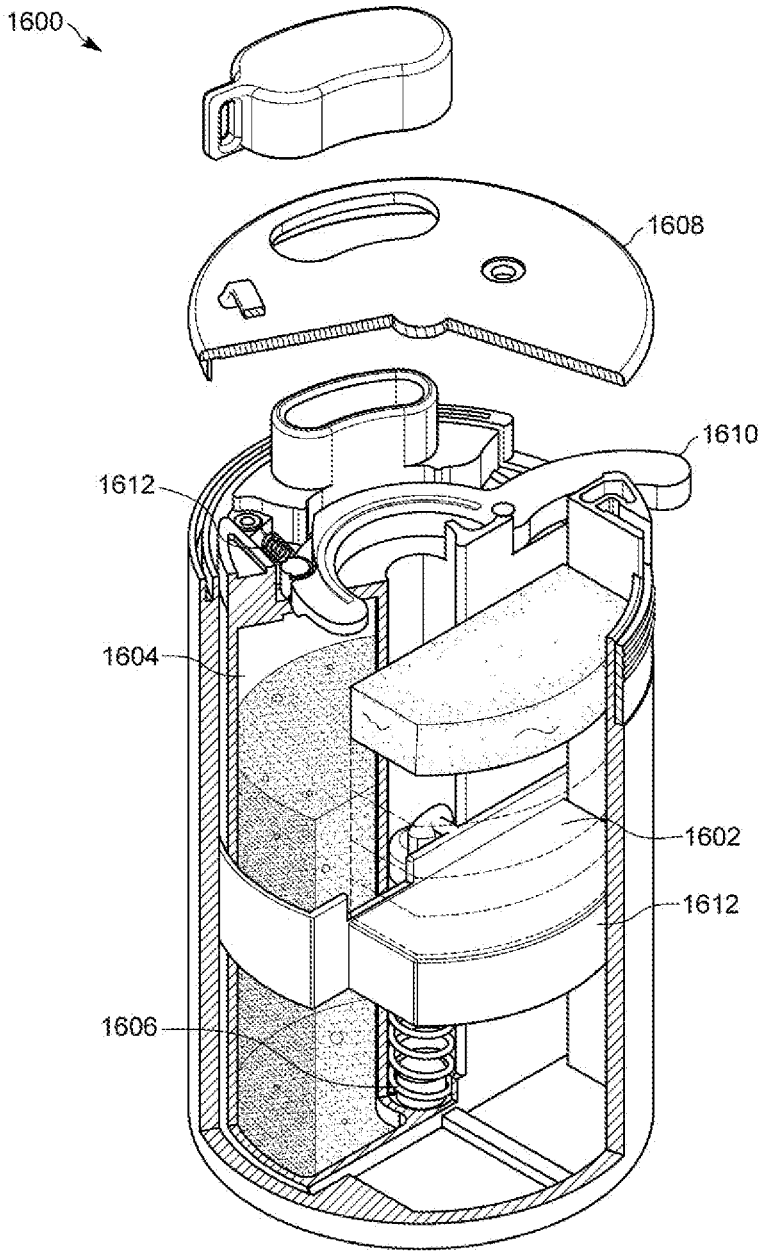
FIG. 16A illustrates an apparatus with a pivoted lever mechanism in accordance with an embodiment of the present invention.
Figure 16B:
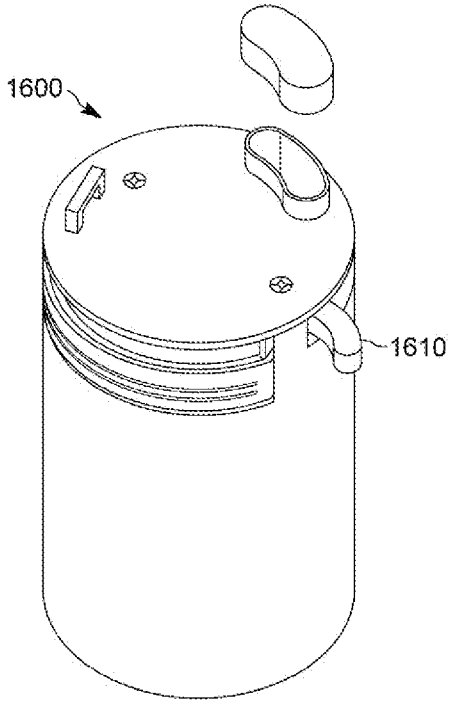
FIG. 16B, 16C illustrates apparatus with Rotatable lever and Flushed lever in accordance with an embodiment of the present invention.
Figure 16C:
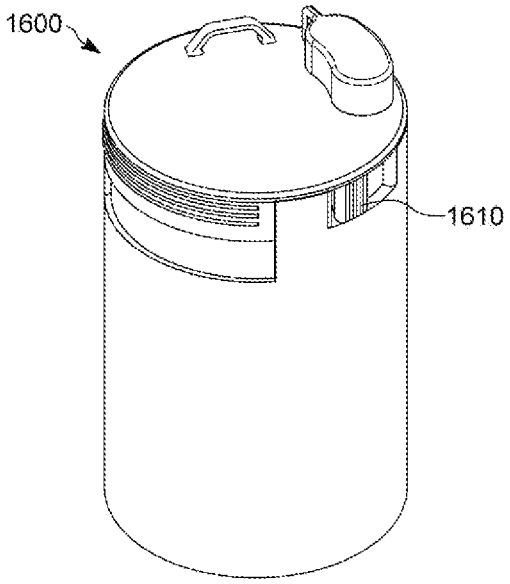

In an embodiment of present invention, the apparatus comprises a pivoted lever to dispense the food patties from the food chamber. FIGS. 16A and 16B illustrates the apparatus showing working of a pivoted lever mechanism in accordance with another embodiment of the present invention. The apparatus 1600 comprises a food chamber 1602, a drink chamber 1604. The food is stacked over a base plate 1612 inside the food chamber 1602. The baseplate is attached to a first spring 1606 located at the center of the container to maintain the balance. The second end of the first spring 1606 is attached to the bottom of the apparatus. The first spring 1606 is in compressed state to store the potential energy, such that when the tension on the first spring is released, the first spring 1606 pushes the base plate 1612 upward to release the food patties/fritters. The top of the apparatus is covered with a covering 1608 to prevent the spillage of the drink. The covering 1608 has an opening for the drink chamber 1604 for the user to drink. The covering supports a pivoted lever 1610 that is rotated to push the patties/fritters outward. The pivoted lever 1610 is connected to a second spring 1612 that keeps the lever in relaxed state and automatically reload the lever for next use. When a user rotates the pivoted lever 1610, the second end of the pivoted lever 1610 pushes the patties/fritters outward and the tension in the first spring 1606 pushes the rest of food patties/fritters upward, to release the food patties/fritters towards the user. Once the food patties is released, the tension in the second spring 1612 automatically reload the pivoted lever 1610 in original state. In some embodiments, the lever can be automatically retracted to its original position manually. For refilling the food chamber, the first spring 1606 at the baseplate can be pushed downward and there is a small groove or slot to lock position stable, so that when the lid is opened to refill the food chamber, the first spring 1606 at the baseplate do not push patties/fritter upside and crush to the top lid. FIG. 16C illustrates the pivoted lever 1610 flushed in shell of the apparatus.

Figure 17A:
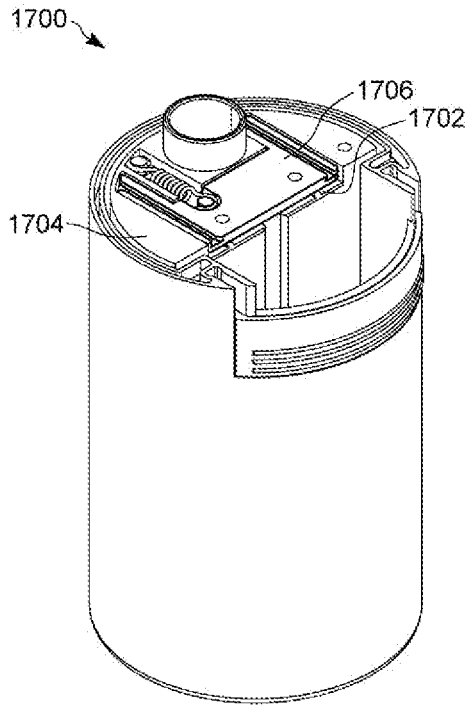
FIGS. 17A, 17B and 17C illustrates a food dispensing apparatus with a slider lever/button mechanism to release the food in accordance with another embodiment of present invention.
Figure 17B:
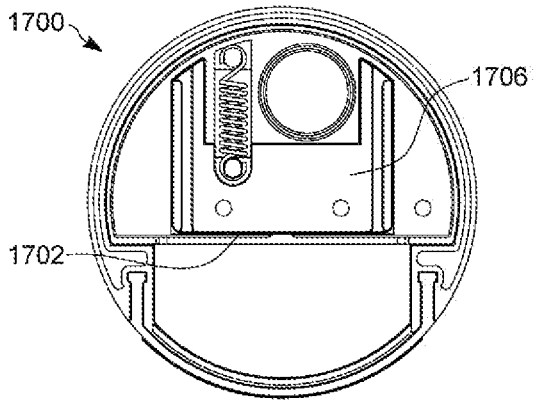
Figure 17C:
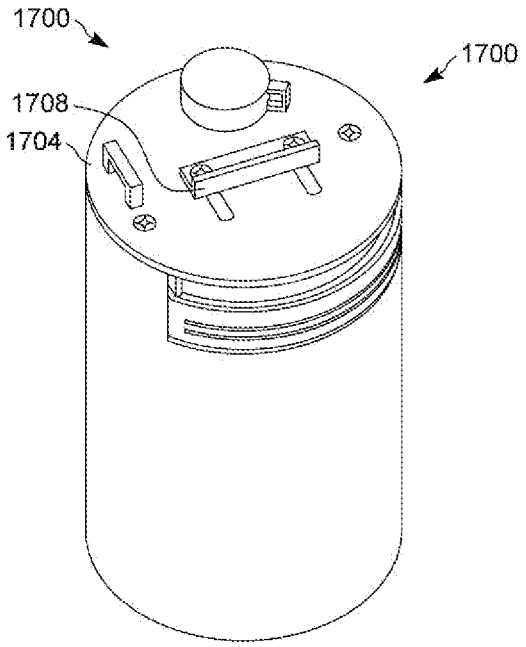

In an embodiment of the present invention, the apparatus comprises a slider lever/button mechanism on top of the lid to release the food from the apparatus. FIGS. 17A, 17B and 17C illustrates a food dispensing apparatus with a slider lever/button mechanism to release the food in accordance with another embodiment of present invention. Referring to FIGS. 17A, 17B and 17C, the apparatus 1700 has a slider lever/button mechanism to release the food fritters/patties. The slider lever/button mechanism comprises a base 1702 connected to the lid 1704 of the apparatus. A clamp 1706 is connected to the base 1702 with a spring mechanism. When the clamp 1706 is moved against the base 1702, the spring mechanism activates the base 1702 to open slit on the apparatus 1700 through which food is dispensed out. A handle 1708 can be coupled to the clamp 1706 using screws. When a user wishes to eat the food patty or fritter from the apparatus, the user can slide the handle 1708 against the base that opens the slit in the apparatus 1700 and the food is dispensed towards the user.

Figure 18:
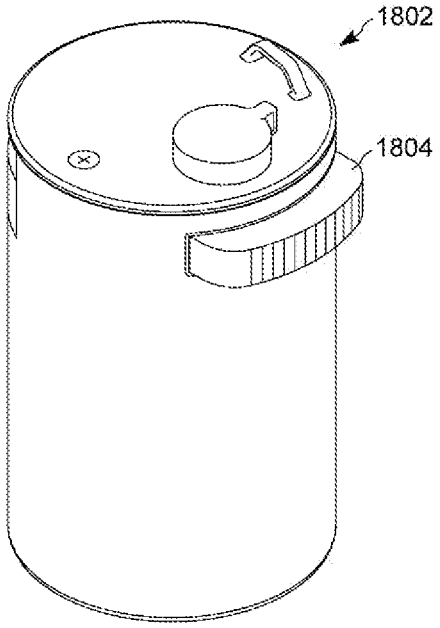
FIG. 18 illustrates the apparatus with push button on side of the apparatus in accordance with another embodiment of the present invention.
Figure 19:
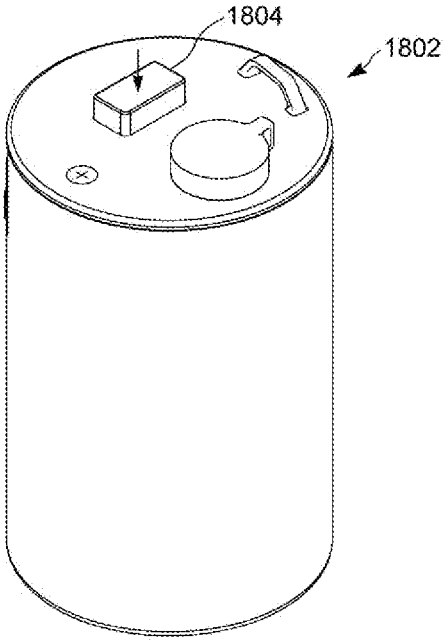
FIG. 19 illustrates the apparatus with push button in place on top cover of the apparatus in accordance with another embodiment of the present invention.

FIGS. 18-19 illustrates the apparatus with push button in place of lever in accordance with another embodiment of the present invention. At the top of the apparatus 1802, a push button 1804, which is slightly embossed is present. The push button 1804 serves the function similar to a lever. When the lever is pressed, the second spring connected to the lid, opens the lid to provide passage to pop-out food and the plate pop the food outside towards the user. The food is popped up at an angle in upward direction towards the user. The lever opens the lid at an angle ranging from 20 degree to 90 degrees that allow the popping up of food at a varying angle from 30 degree to 90 degree. FIG. 19 illustrates the external push button 1804 on top of the apparatus 1802. The external push button 1804 on top of the apparatus is pushed vertically down to release the food patties/fritters outside.

Figure 20:
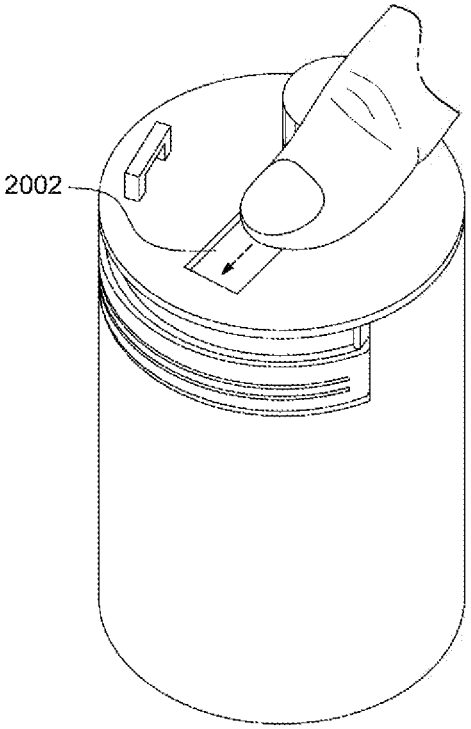
FIG. 20 illustrates an apparatus to dispense food and drink wherein the user pick up the food/fritters manually in accordance with an embodiment of the present invention.

In an embodiment of the present invention, the food patties/fritters can be released manually from the apparatus. FIG. 20 illustrates an apparatus to dispense food and drink wherein the user pick up the food/fritters manually in accordance with an embodiment of the present invention. In this embodiment, a space 2002 is provided on the top of the lid through which user can slide the food patties/fritter outward. The first spring at the bottom of the apparatus pushes the rest of the food patties/fritters in the upward direction. The apparatus has a lid on the top of the apparatus to cover the external case at top. The external case has a slit opening at the front side from where user can manually pick the food items. The opening on the external cased can be sealed with a protective sticker or film to protect food from being exposed to outer environment. The user has to remove the sticker or film before using the apparatus to pop food out. A flexible straw lid is provided on the top of the apparatus that extends and runs into the drink chamber. The flexible straw lid can be retracted back when not in use and extended when a user wants to drink from the apparatus. Using the flexible straw lid, the user is able to drink the content stored in the drink chamber.

Figure 21:
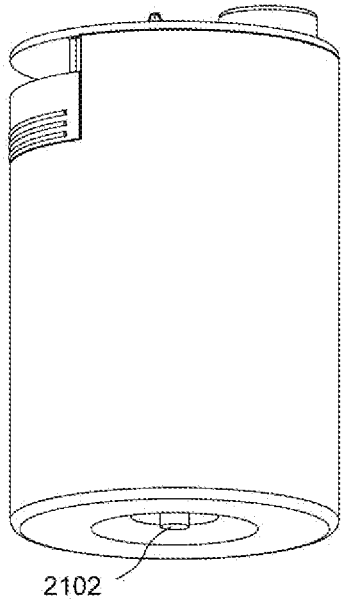
FIG. 21 illustrates an apparatus with a spring tension adjustment screw in accordance with an embodiment of the present invention.

In an embodiment of the present invention, the apparatus is provided with a spring tension adjustment screw to counter various types of food. FIG. 21 illustrates an apparatus with a spring tension adjustment screw in accordance with an embodiment of the present invention. The spring adjustment screw 2102 is provided at the bottom of the apparatus and is connected to the first spring inside the shell of the apparatus. In some models of the apparatus, the spring adjustment screw can be located at the external side of the food chamber. The spring adjustment screw 2102 is rotated clockwise or anticlockwise to release or build tension in the first spring. The spring adjustment screw 2102 is used to counter or compensate different type of foods and its weights. For heavy weight food materials, the first spring is recoiled to build tension and to store more potential energy.

Figure 22:
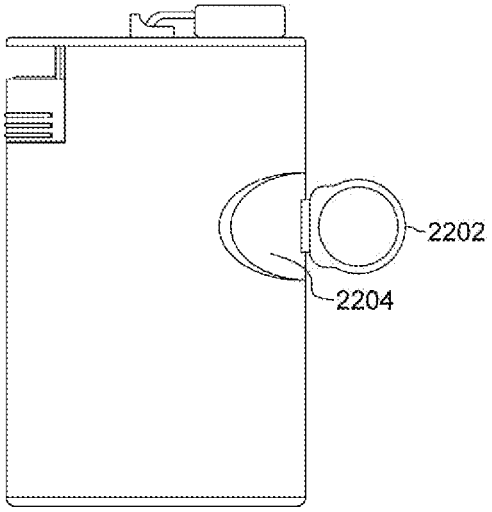
FIG. 22 illustrates the apparatus with a grip holder 2202 for holding the apparatus by a user in accordance with another embodiment of the present invention.

In some embodiments, the apparatus of the present invention is provided with a holder for holding the apparatus. The holder can be in shape of ring, circle, trapezoidal or any other geometrical shape that allows the user to hold the apparatus with comfort. The holder has a gripping material on the surface to provide a better grip. The ring is attached at the external side of the drink side container preferably located at the middle of the external container to hold comfortably by inserting finger to avoid accidental dropping of the container. The ring is collapsible ring, and when not in use, the ring can be pressed downward or parallel to the container wall. The gripping material can include, but is not limited to rubber, polymeric material or other plastic, metal, alloy, fabric, composite material or other material capable of increasing the adhesion, grip or coefficient of friction between the gripping surfaces. FIG. 22 illustrates the apparatus with a grip holder 2202 for holding the apparatus by a user in accordance with another embodiment of the present invention. The grip holder 2202 is in ring shaped, however, the shape of the grip holder 2202 can be in any geometrical form. The external shell of the apparatus can be provided with a housing 2204 for looping in or out the grip holder 2202.

Figure 23A:
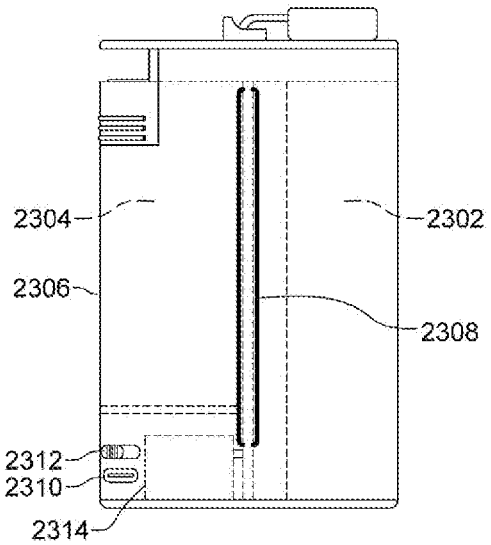
FIGS. 23A and 23B shows the apparatus with the heating element and electric circuitry in accordance with an embodiment of the present invention.
Figure 23B:
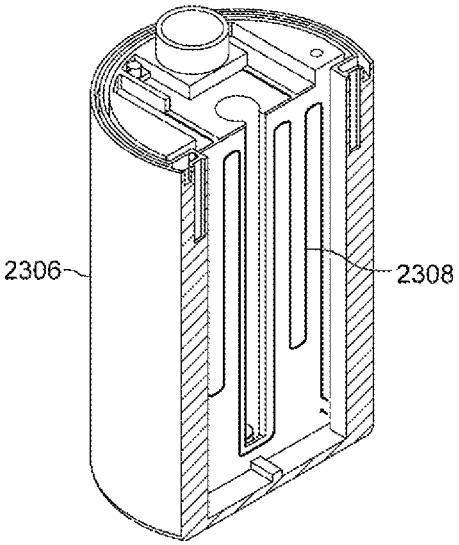

In order to heat the food the apparatus is provided with a heating element besides the food container. FIGS. 23A and 23B shows the apparatus with the heating element and electric circuitry in accordance with an embodiment of the present invention. The apparatus has a drink chamber 2302 for storing a drink, and a food chamber 2304 for storing food. The external shell 2306 of the food chamber is provided with a heating element 2308 to heat the food content stored in the food chamber. The external shell 2306 of the food container is lined with the heating element 2308 so as to heat the food content when needed. The heating element 2308 is connected with electric circuitry to regulate the working of the heating element. A USB power port 2310 is provided to electrically connect the heating element 2308 with a power supply. The apparatus is provided with a switch button 2312 to regulate power supply to the heating element. To regulate heat, there are four options in the switch, namely Heating On/Off switch option can be selected separately for the Food chamber and the Drink chamber or combined for food chamber and the drink chamber or completely OFF position when needed the user can connect the USB power port 2310 for external power supply and use the switch 2312 to regulate the working of the heating element. Additionally, the apparatus includes a battery unit 2314 responsible for providing power to the electrical circuitry and it also provides power supply to the DC motor if the upper lid is equipped with a push-button switch for turning on the DC motor.

In another embodiment of the present invention, the food can be loaded rapidly in the food chamber of the apparatus. The food stack can be loaded rapidly in multiple ways through manual or automation methods. One way of loading the food container is through top loading where the top lid of the container is opened and vertically food stack patties are loaded through opening of the top lid. Another method to rapidly load food in the food chamber by providing a vertical or horizontal opening that can be opened through a hinge. The horizontal or vertical opening can be opened through the hinge connecting through the drink chamber and the food chamber can be loaded rapidly. Another method for providing rapid loading of food items in the food chamber utilizes food container where the top layer or cover can be opened horizontally through rotatable way. The top layer or cover comprises threads to cover the top or the apparatus. The cover can be simply removed unwinding the thread. Once removed, the food items can be loaded in the food chamber and the cover is closed. Another method to load the food items rapidly in the food chamber is vertical collapsing model. In vertical collapsing model, there is a hinge in the bottom of the apparatus that can be pulled down and food items are loaded in the food chamber and the container is then closed or sealed.

Figure 24:
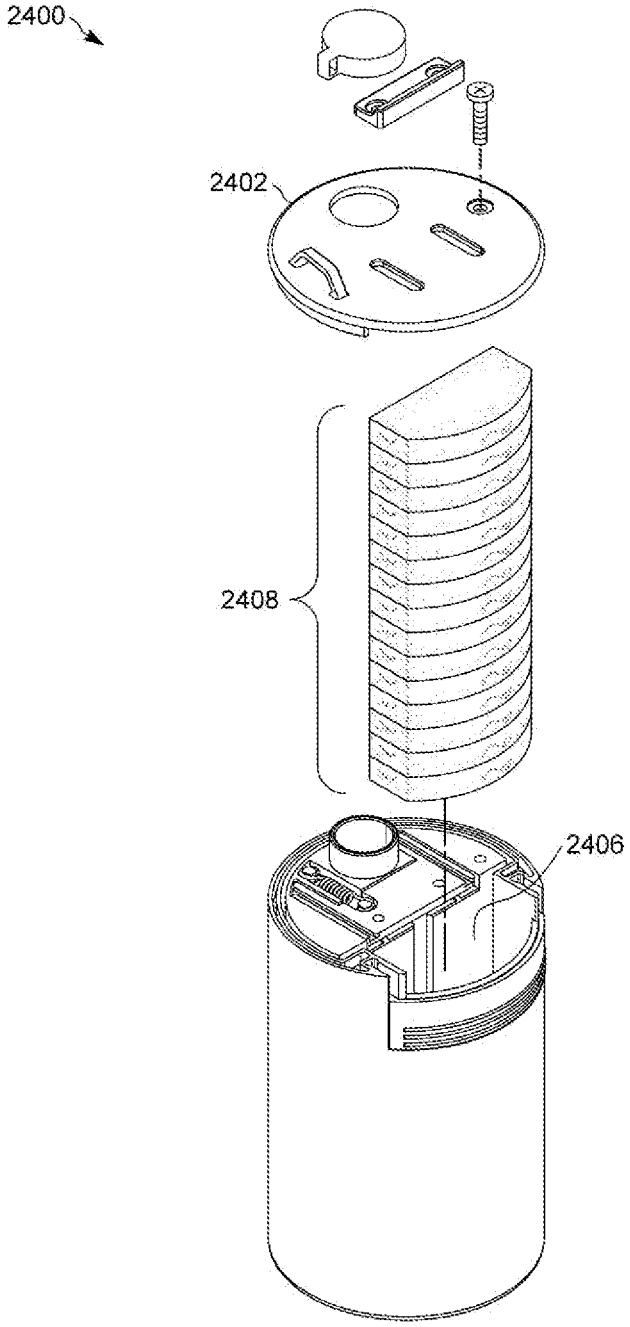
FIG. 24 to FIG. 29 illustrates loading method for loading food stack in the food chamber of the apparatus in accordance with an embodiment of the present invention.

FIG. 24 to FIG. 29 illustrates loading method for loading food stack in the food chamber of the apparatus in accordance with an embodiment of the present invention. Referring to FIG. 24, an exemplary embodiment showing top loading of the food stack is illustrated. The top cover 2402 of the apparatus 2400 is unscrewed to remove the top cover 2402 from the apparatus in order to expose the food chamber 2406 for loading the food stack 2408. The food content is stacked in layers as per the dimension of the food chamber. The food stack 2408 is then filled into the food chamber 2406 to load the food chamber. The top cover 2402 is then fitted over the apparatus 2400 and screwed to lock the apparatus.

Figure 25:
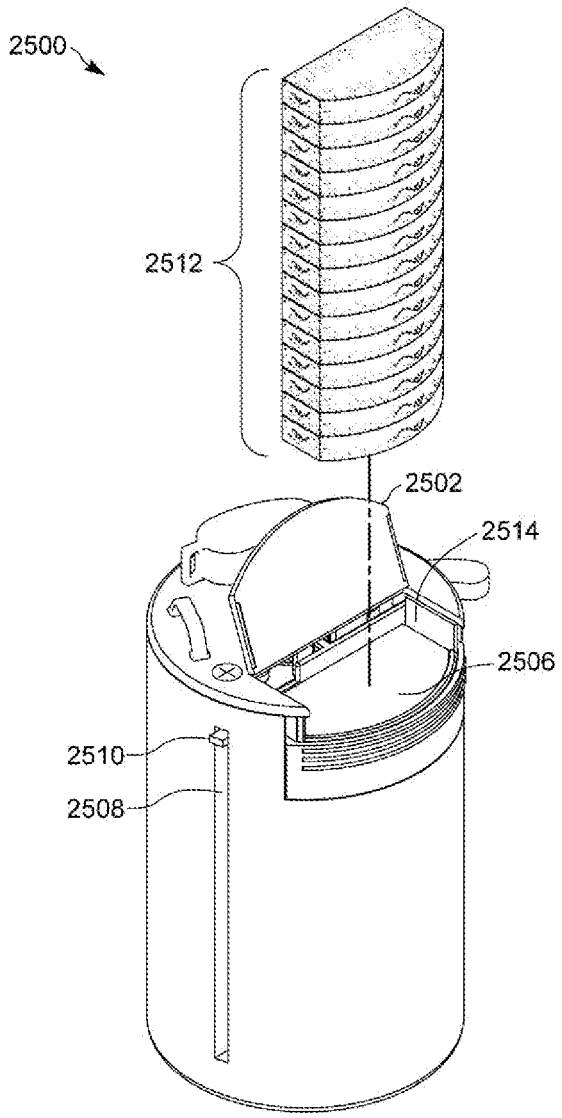

Referring to FIG. 25, the apparatus 2500 comprises a hinged lid 2502 over the food container 2506. The top cover of the apparatus has a vertical or horizontal flap 2502 that is connected through a hinge and can be opened or closed using the hinge to provide an opening 2514 over the food container 2506. A slit 2508 is provided on the side of the apparatus though which a lever 2510 is connected to the baseplate over which food stack are loaded. The lever being connected to the baseplate is used to move the baseplate to the bottom of the apparatus so as to provide the space for food stacks 2512 to be loaded. The vertical stacked food content 2512 is inserted into the opening 2514 at the top container. Once loaded, the vertical or horizontal flap 2502 is closed through the hinge.

Figure 26:
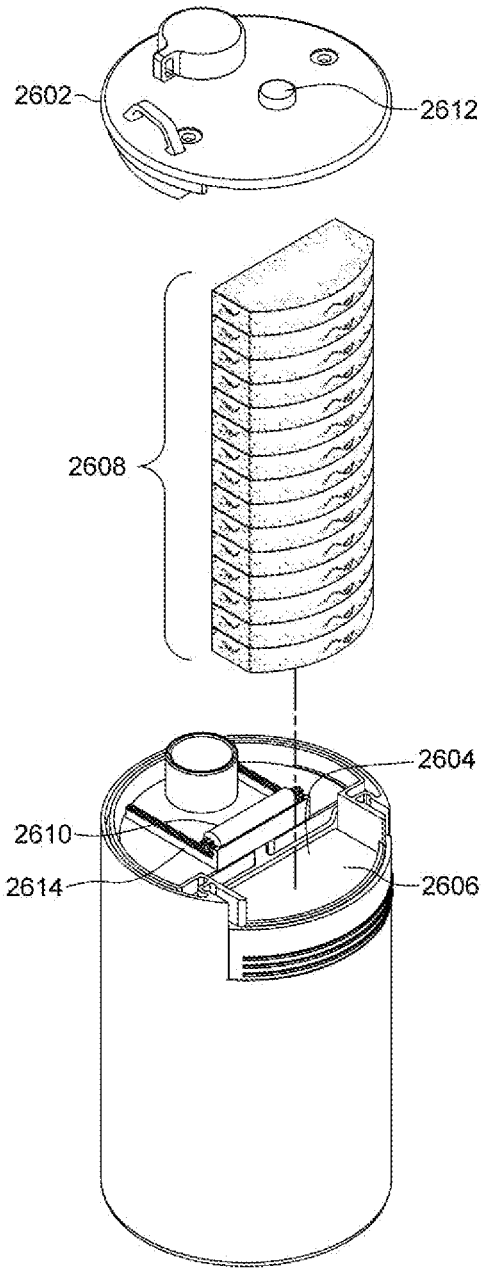

Referring to FIG. 26, another embodiment of vertically loading food stack in the food container is illustrated. The upper unit or the top cover 2602 of the apparatus is detachable and quickly removed to expose the opening 2604 for the food container 2606. The baseplate of the food container is pushed at the bottom for loading the food stack 2608. The vertically placed food stack 2608 is then quickly loaded into the food container 2606. Once the food container 2606 is loaded with food content 2608, the upper unit or the top cover 2602 is attached over the apparatus. Various types of loadings (Top, Bottom, Horizontal, Vertical etc.,) are mainly for rapid loading especially for Vending machines auto loading or manually also.

In an embodiment of present invention, the apparatus with the push button 2612 may be connected to a Micro/Mini/Standard DC servo, stepper or customized DC motor 2610, so that when the push button/power switch 2612 is pressed, it gets power from rechargeable battery, it activates the DC servo or stepper motor 2610 and the sliding tracks 2614 pushes food towards the user. The DC servo or stepper motor 2610 is placed inside the lid or some models DC Motor can be located next to sliding tracks or under the lid with waterproof cover, and connected to the sliding tracks 2614 for easy dispensing of food fritter/patties without need of any force. The DC servo or stepper motor 2610 is also useful for the apparatus with not only for single food chamber but also multiple food chambers/compartments to aid in switching the opening of the apparatus with particular food chamber with help of small lcd/led screen and also same (DC Motor mechanism method for push button) can apply to other types like Flushed Rotating Lever button, external push button models also.

Figure 27:
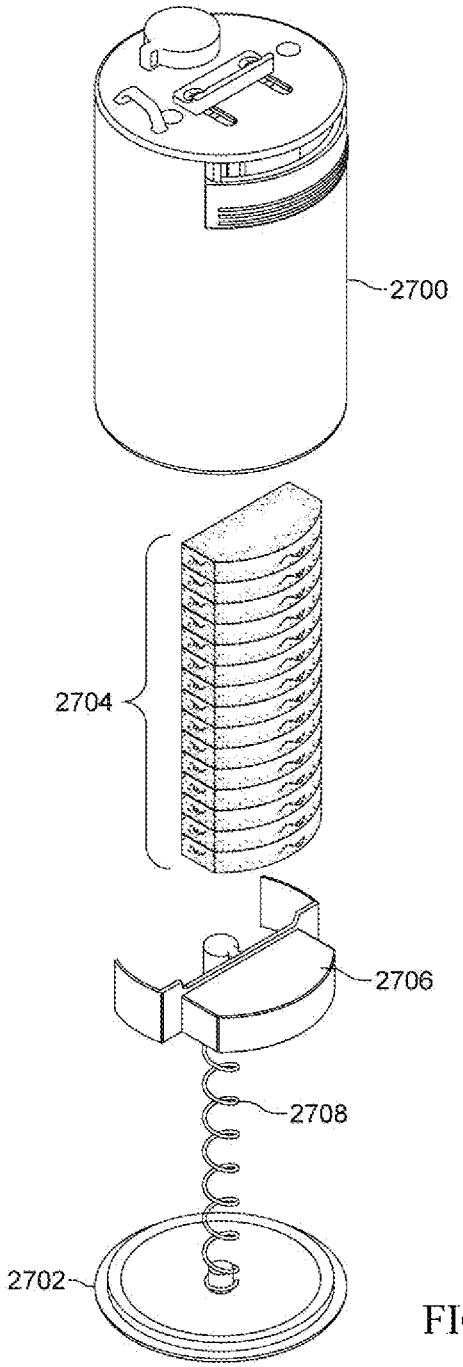

Referring to FIG. 27, loading the food content through bottom down approach is illustrated. The bottom of the apparatus 2700 has a bottom cover 2702 that can be detached from the apparatus 2700. The food stack 2704 ready to load is first inserted into the food chamber and the base plate 2706 is pressed against the case to push the vertical spring 2708 down to touch the bottom cover 2702. The bottom cover is then fixed with the case.

Figure 28:
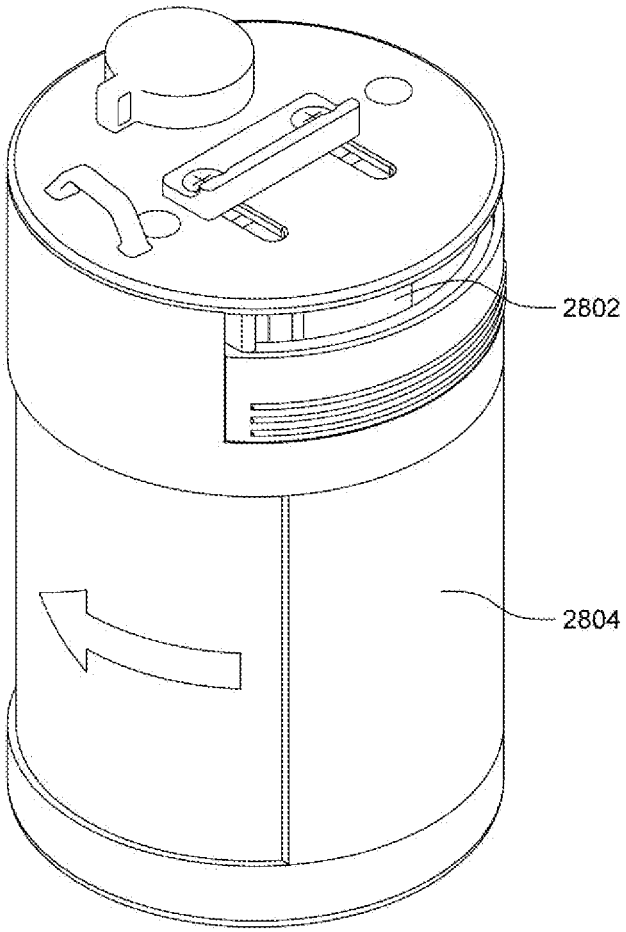

Referring to FIG. 28, an apparatus with accessible food compartment for loading the food stack is illustrated. The food chamber 2802 of the apparatus is provided with a rotatable shell 2804 that slides sidewise to open the food chamber 2802 from outside. The loaded food stack are then inserted into the food chamber 2802. The rotatable shell 2804 is then slides back to cover the food chamber 2802.

Figure 29:
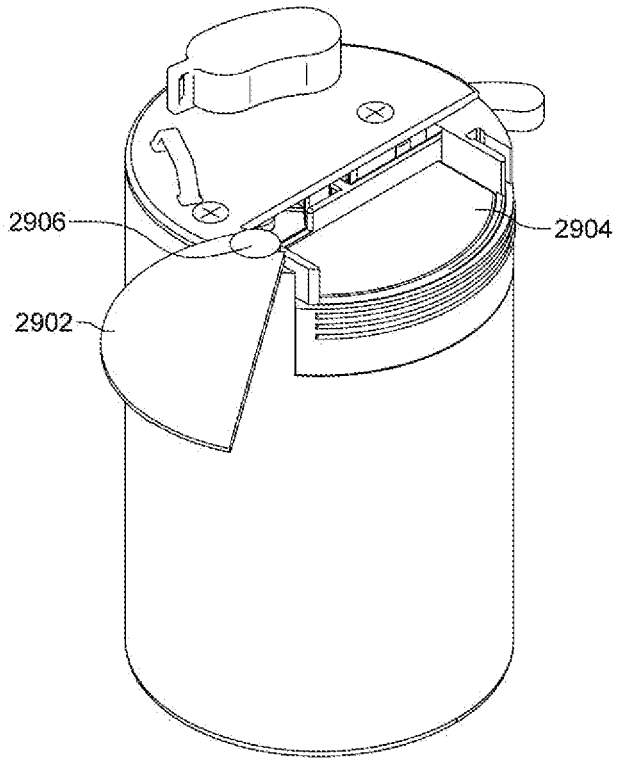

Referring to FIG. 29, the top cover 2902 of the food chamber 2904 of the apparatus is fixed through a pivot joint 2906. The top cover 2902 is rotated over the pivot joint 2906 to expose the opening at the top of the food chamber 2904. The food stack is then loaded through the opening in the food chamber 2904 and the top cover 2902 is again rotated to seal the food chamber.

Figure 30:
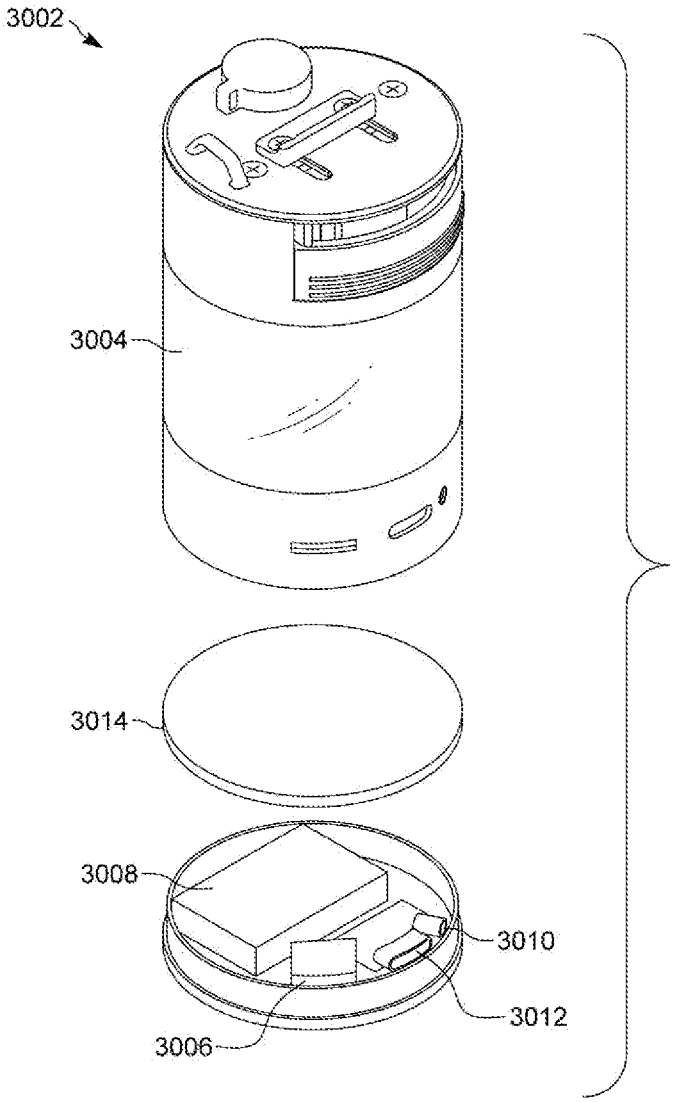
FIG. 30 illustrates a food dispensing apparatus with a display and electric circuitry component in accordance with an embodiment of the present invention.

In another embodiment of present invention, the external casing of the apparatus can further be provided with a display screen, housing for a charging port, a USB port, a memory card and a battery. FIG. 30 illustrates a food dispensing apparatus 3002 with a display 3004 and electric circuitry component in accordance with an embodiment of the present invention. The display screen 3004 is wrapped around the whole apparatus or over some area of the apparatus. The display screen 3004 is connected to a memory unit 3006 to store program or digital content and is configured to display the digital content (e.g., image, text, video, audio, music etc.). The display screen 3004 allows the companies to display their food or other advertisements to attract customers or merchandise. The flexible display screen can be reusable or disposable.

The apparatus 3002 further comprises electronic circuitry as a combined or separate attachment module, such as battery 3008, circuit board etc. inside the external casing or in the bottom cap to drive any electronic component of the apparatus. The electric circuitry may further comprise a charging port 3010 and USB port 3012 for providing power supply and to transfer additional information to the memory card of the apparatus. Further the apparatus 3002 further comprise a thermal protection layer 3014 preventing the heat and current from the electric circuitry to enter in food and drink chambers.

Figure 31:
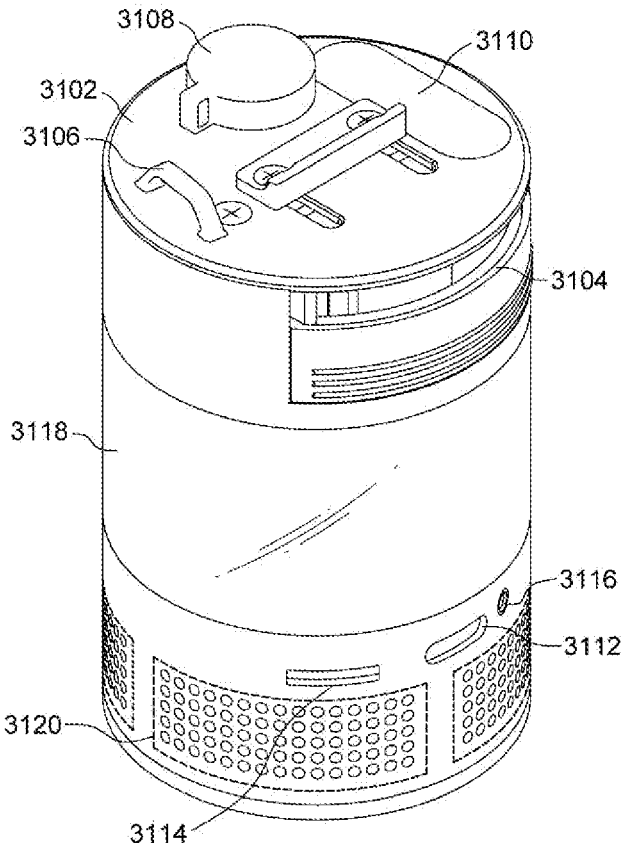
FIG. 31 illustrates a food dispensing apparatus with a speaker and electric circuitry component in accordance with an embodiment of the present invention.

Referring to FIG. 31, the top cover 3102 of the apparatus comprises a push back mechanism for dispensing the food from the food chamber through the opening 3104 on the apparatus. The top cover 3102 of the apparatus further comprises a handle 3106 for holding the apparatus, an opening 3108 for the drink chamber, a cap to cover the opening. The top cover 3102 further comprises a small chamber 3110 for storing miscellaneous items. The external shell of the apparatus comprises opening for a USB port 3112, a slot for memory card 3114, a power supply inlet 3116. The apparatus comprises a display 3118 at the external shell to display advertisements. The apparatus comprises a speaker 3120 for notifications, alarm and audio advertisements.

Figure 32:
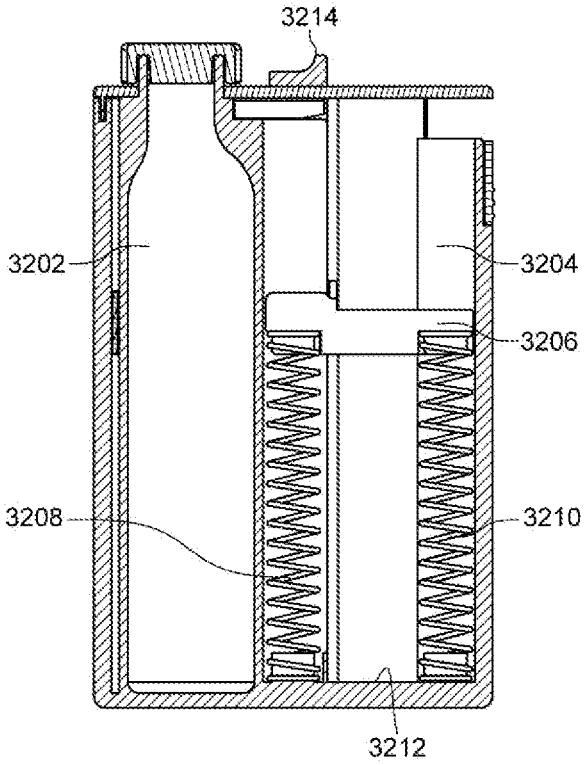
FIG. 32 illustrates an apparatus to dispense food and drinks to a user with dual springs at the baseplate of the food chamber in accordance with an embodiment of the present invention.

In an embodiment of the present invention, the food chamber in the apparatus comprises a single spring or a double spring. In case of single spring, one spring is present at the center of the container to support the base on which food stacks are placed. In case of dual spring, one spring is present at the center of the food chamber and the second spring is provided at the food chamber outer shell end to balance food stack base with two springs for more stability to counter wear and tear of single spring mechanism or both springs are located at sides or close to external shell/layer for more stability to counter wear and tear of single spring mechanism and also even if one spring fails still it can work with the second spring. The dual spring are preferably provided with re-usable apparatus. FIG. 32 illustrates an apparatus to dispense food and drinks to a user with dual springs at the baseplate of the food chamber in accordance with an embodiment of the present invention. The apparatus comprises a drink chamber 3202 for storing the drink and a food chamber 3204 for storing the food content over a baseplate 3206. The base plate 3206 is connected to the base of the apparatus by a first spring 3208 and a second spring 3210. The first spring 3208 and the second spring 3210 are vertical springs connected the base 3212 of the food chamber 3204 with the baseplate 3206 over which food fritters are stacked. The top cover of the apparatus comprises a lever 3214 to push the food patties/fritters towards the user. The lever 3214 is a horizontal bar based on push mechanism to push the food content outside and the bar shaped lever hold rest of food stack down to release the patty smoothly without any friction caused by the first spring 3208 and the second spring 3210 in the upward direction.

In an embodiment of present invention, a lock and skid mechanism for reducing spring tension is provided. The mechanism reduces friction on food patties with regard to slider button or lever. In one implementation of lock and skid mechanism, when a user pressed the lever to push the patty towards the user, at the same time underlying another lever can hold the rest of food patties to reduce the friction on top of the patty. Once the top patty is released towards the user, the underlying lever is released.

In another implementation of lock and skid mechanism, the food patty can be lifted at the top and push through lever without any friction. At the same time, the second lever can keep all the food patties intact or locked position without pushing in upward direction to make sure that no friction on the top most food patty, so that the patty can be pushed easily.

Figure 33:
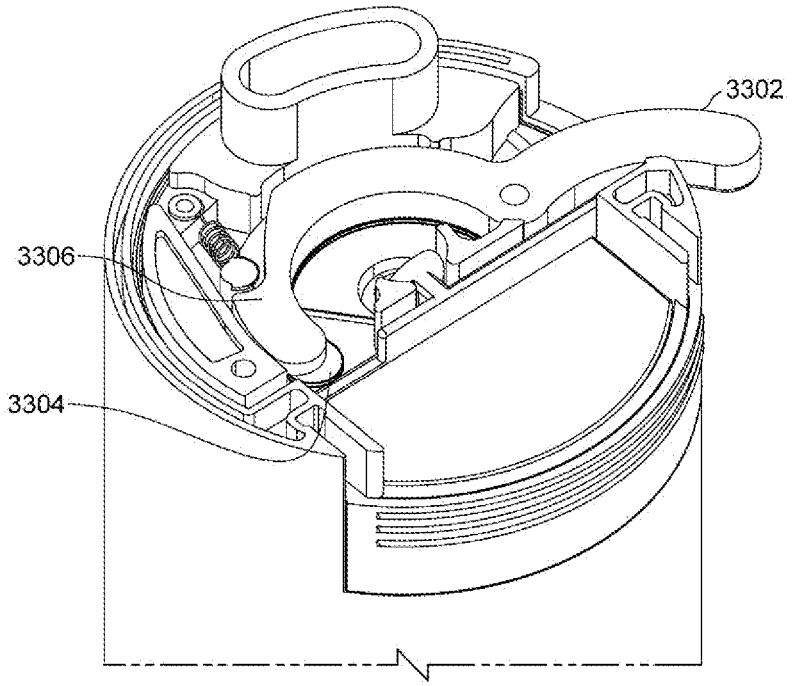
FIG. 33 illustrates an apparatus with a lever to provide lock and skid mechanism in accordance with an embodiment of the present invention.

FIG. 33 illustrates an apparatus with a lever to provide lock and skid mechanism in accordance with an embodiment of the present invention. The apparatus has a lever 3302 on the top cover to push the patties towards the user. The lever is split into two parts: a first part 3304 and a second part 3306, the first part 3304 extends downward and can easily go beneath the food patty when lever is pressed so as to reduce the upward pressure on the top patty. The second part 3306 is horizontal moving part that reaches with slight delay towards the top patty and pushes the food patty out with less friction from the downwards patties. In some embodiments, the first part 3304 and the second part 3306 of the lever activated by a single press of lever but act independent of each other.

In another embodiment of the present invention, the apparatus or the food container is modular and can be assembled into a single unit. The whole apparatus can be provided with multiple modular parts that can be assembled to form the apparatus. The various modular part of the apparatus may comprise food chamber, spring mechanism, drink chamber. The modular components can be attached through with the help of internal hinge mechanism or other methods so that the modular components can be easily attachable or detachable. The use of modular apparatus finds its implementation in disposable or non-disposable apparatus. In case of non-disposable apparatus, a user can open the container and load the food chamber and the drink chamber quickly. The drink chamber can be loaded with half or semi-circle can with disposable lid. In the food chamber, the user can quickly load food patties from the pack purchased from various food manufacturers after peeling the cover and for locking by push from both left and right sides towards middle spring mechanism chamber to lock it securely or to click to start using food container.

In case of disposable container, food and drink manufactures can pre-load both food and drink contents and sell it as a disposable container as a complete package. Food patties are already pre-loaded, so no manual intervention is needed. However, for drink chamber, the user needs to just pull the lid or pushing the straw through hole to consume the drink. After consuming the drink, the whole container can be disposed.

Figure 34A:
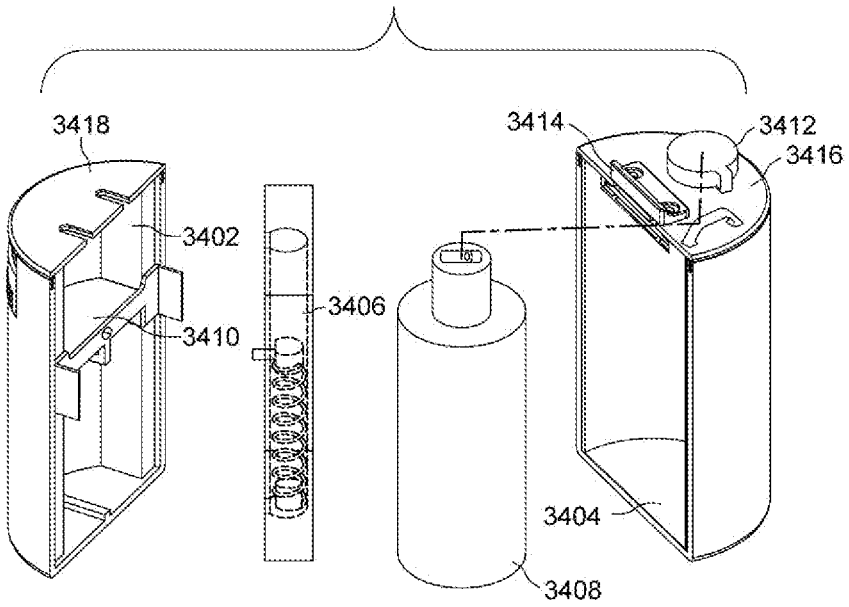
FIGS. 34 to 36 illustrates an apparatus for dispensing food and drink showing modular components in accordance with an embodiment of the present invention.
Figure 34B:
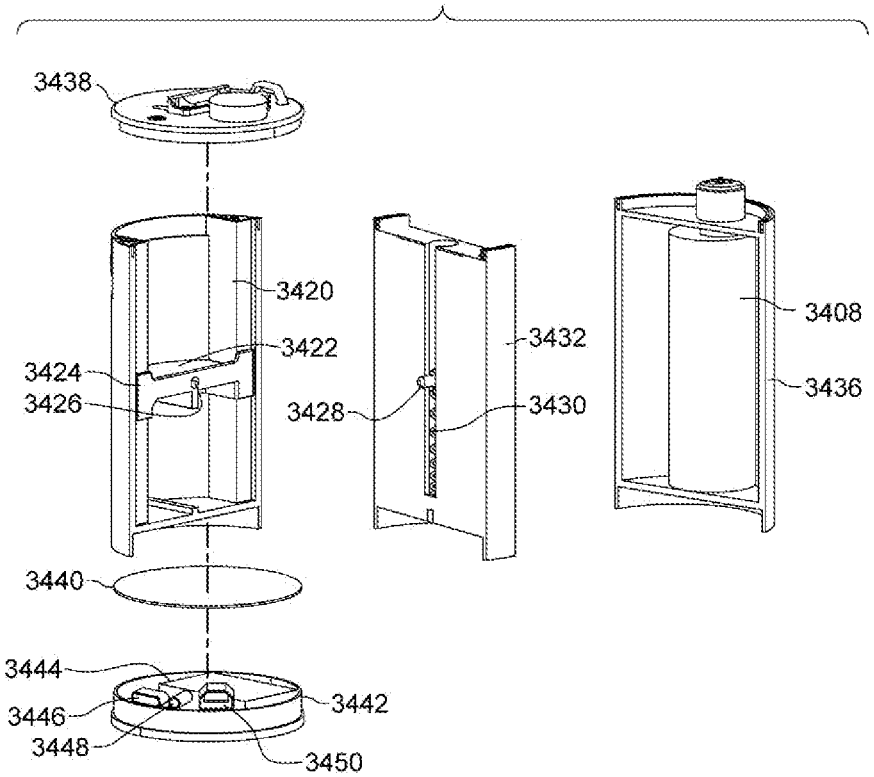
Figure 35:
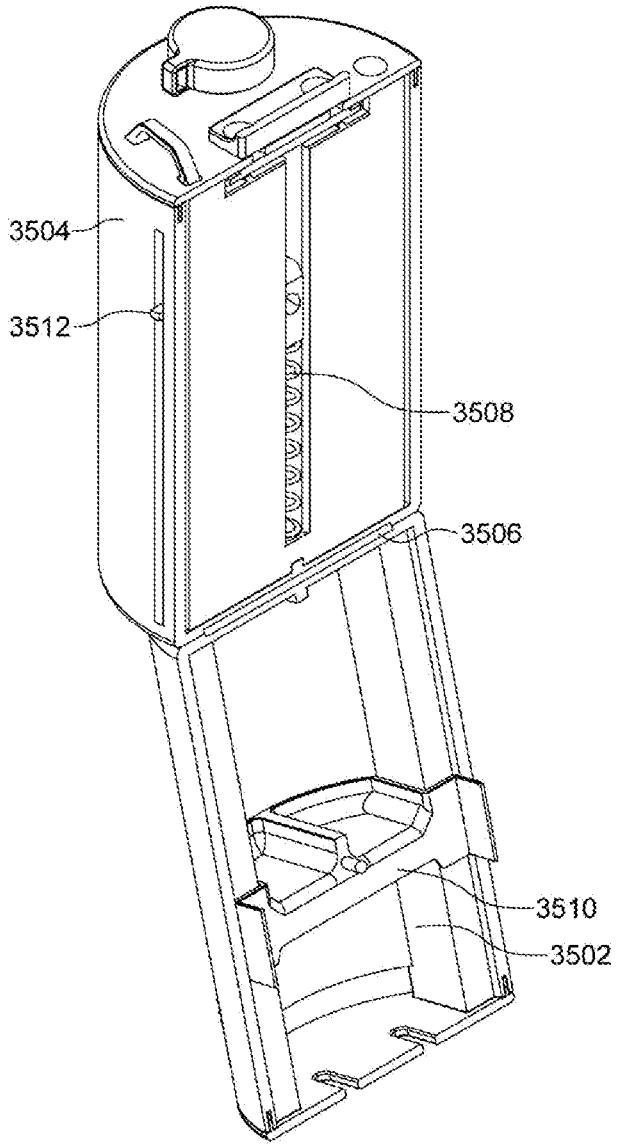
Figure 36:
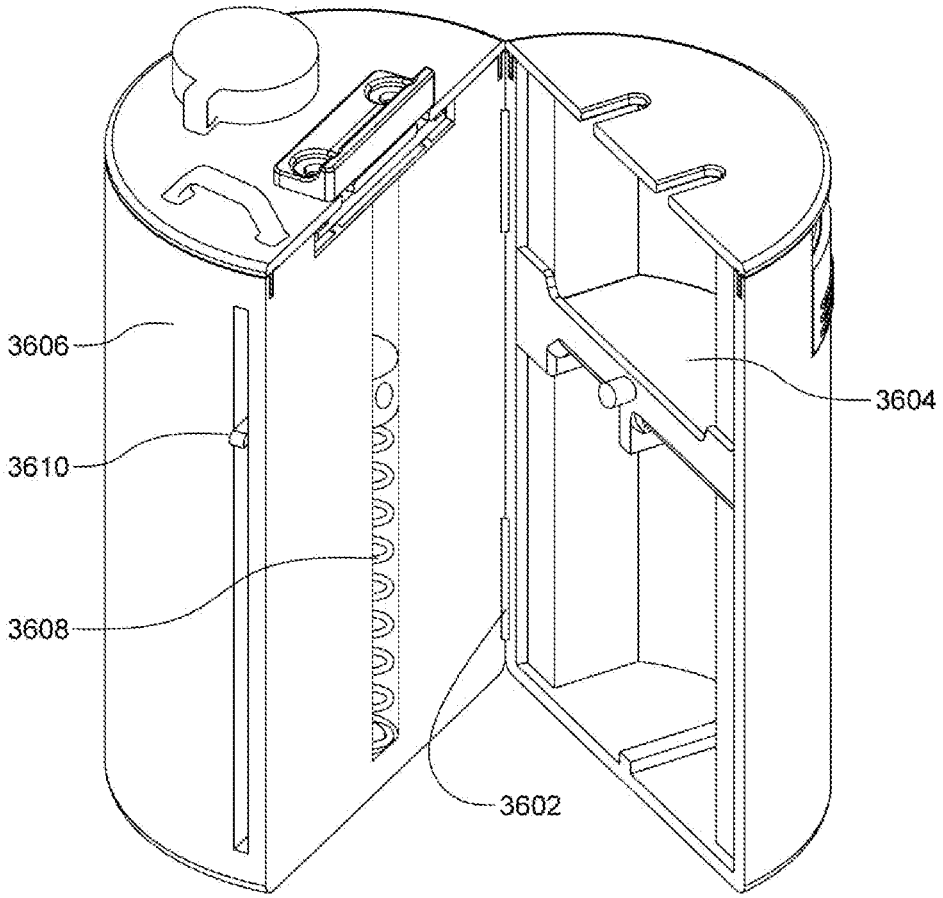

FIGS. 34 to 36 illustrates an apparatus for dispensing food and drink showing modular components in accordance with an embodiment of the present invention. Referring to FIG. 34A, the apparatus comprises a plurality of modules that can be assembled to create a single unit of apparatus. The plurality of modules comprises a food chamber 3402 as a separate unit, a drink chamber 3404, a vertical spring module 3406 and a packaged drink 3408. The food chamber module 3402 and the drink chamber modules 3404 are independent unit that can be assembled or connected together by fitting with each other. The food chamber module 3402 has a food chamber for storing food patties, a base plate 3410 over which food stack/patties can be placed. The drink chamber module 3404 comprises space for a packaged drink 3408 that can be fitted inside the drink chamber. The drink chamber module 3404 has a cap 3412 on the top cover 3416 for the packaged drink, and a lever 3414 to push the food patties/stack. The top cover 3418 of the food chamber has corresponding slit for the lever 3414, so that once the food chamber module 3402 and the drink chamber module 3404 are connected or attached, the lever 3414 can function to push the food content. The vertical spring module 3406 can be connected at the bottom of the base plate at first end and the base of the food chamber at the second end.

Referring to 34B, the apparatus for dispensing food and drink comprises a hollow semi-circular shaped food chamber module 3420, the inside of which can be used to store the food stack. A base plate 3422 is provided inside the food chamber module 3420 to place the food stack over it. The base plate 3422 has an arm extension 3424 extending from below the base plate 3422, the arm extension 3424 has an engagement member 3426 for locking into an extension of a vertical spring 3430 of a vertical spring module 3432. The vertical spring module 3432 is a bar shaped vertical module that comprises a slot for the vertical spring 3430 to move upward and downward. The top of the vertical spring has a locking member 3428 that fitted into the engagement member 3426 of the arm extension 3424 of the baseplate 3422 in the food chamber module 3420, so that the movement of the base plate 3422 is regulated by the movement of the vertical spring 3430. The drink chamber module 3436 is a hollow semi-circular chamber in which packaged drink content is placed. The food chamber module 3420, the vertical spring module 3432 and the drink chamber module 3436 is fitted together to create a single unit of the apparatus. The top of the apparatus is fitted with a top plate module 3438 that comprises a lever, a handle, a cap for the drink chamber. The top plate module 3438 is attached over the apparatus by combining the food chamber module, the vertical spring module 3432 and the drink chamber module 3436. The bottom of the apparatus comprises a thermal protecting layer 3440 and a bottom cover 3442. The bottom cover 3442 comprises a housing for accommodating a rechargeable battery 3444, a USB port 3446, a charging port 3448, a display port 3450. The thermal protecting layer 3440 is placed at the base of the food chamber module 3420, the vertical spring module 3432 and the drink chamber module 3436 when combined together. The bottom cover 3442 is attached to the bottom of the apparatus. The top plate module 3438 and the bottom cover 3442 are connected to the apparatus through any attachment means, such as screw or a locking mechanism.

Referring to FIG. 35, a modular apparatus with a hinge mechanism to separate the food chamber and the drink chamber is illustrated. The apparatus comprises a food chamber 3502 and a drink chamber 3504 connected through a hinge 3506 at the bottom, so that the food chamber 3502 and the drink chamber 3504 can be separated vertically through the hinge 3506. The food chamber 3502 can be stacked with food patties when opened. In order to position the spring 3508 with the level of the baseplate 3510 in the food chamber 3502, a spring lever 3512 is provided in the apparatus to position the spring 3508 downward or upward. The top cover comprises a cap for drink chamber, a lever and a handle.

Referring to FIG. 36, the apparatus with a vertical hinge 3602 connecting the food chamber 3604 and the drink chamber 3606 is illustrated. The food chamber 3604 and the drink chamber 3606 are connected with each other through a vertical hinge 3602 that allows the opening of the apparatus horizontally. The apparatus can be opened by rotating the food chamber 3604 or the drink chamber 3606 horizontally so as to access the food chamber. The food chamber can be loaded with the food stack/patties and the apparatus is closed by positioning the spring 3608 with the help of a spring lever 3610.

Figure 37A:
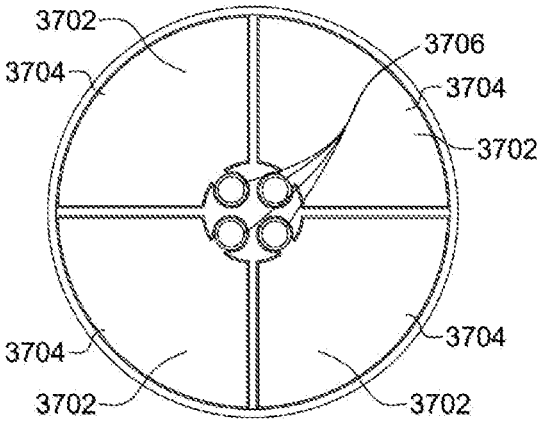
FIGS. 37A, 37B and 37C illustrate various possible configuration of plurality of chambers in the apparatus in accordance with an embodiment of the present invention.
Figure 37B:
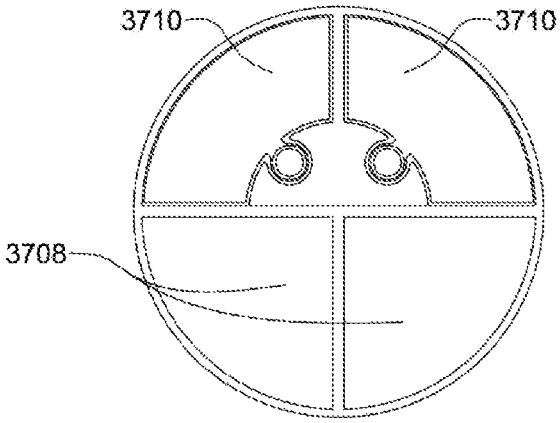
Figure 37C:
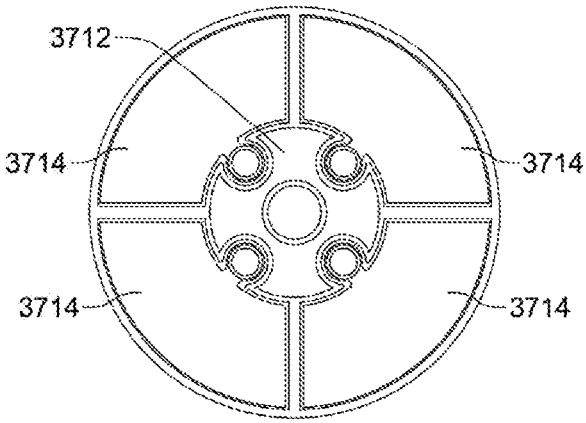

In an embodiment of present invention, the apparatus of the present invention contains a single chamber or a plurality of chambers. The apparatus may contain a single chamber for storing food or drinks or in other implementation, the apparatus may contain a plurality of chambers for storing food content or drink container. FIG. 37 illustrates various possible configuration of plurality of chambers in the apparatus in accordance with an embodiment of the present invention. Referring to FIG. 37A, the apparatus comprises four food chambers or compartments in the apparatus. Each of the four food chamber 3702 comprises a food baseplate 3704 connected to the base through vertical spring 3706. Referring to FIG. 37B, in an exemplary implementation, the apparatus comprises four compartments, out of which two compartments are for the drink chamber 3708 and the two compartments are for the food chamber 3710. Each of the food chamber has a vertical spring connected to the base plate of the food chamber. Referring to FIG. 37C, the apparatus with five compartments is shown, in which the circular compartment is at the center and is meant for the drink chamber 3712, and the around the center circular compartment, four food compartments are there for the food chamber 3714. Each of the four food chamber has a vertical spring connecting the bottom to the base plate of the food chamber.

Figure 38:
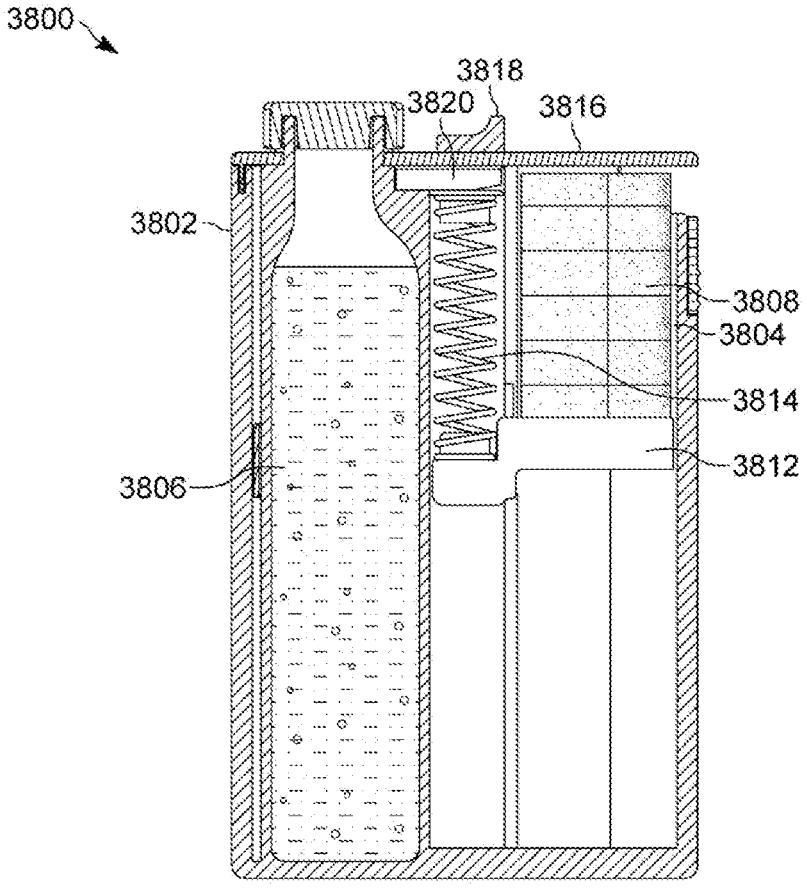
FIG. 38 illustrates an apparatus with a downward spring connected to a base plate in accordance with an embodiment of the present invention.

In an embodiment of the present invention, the spring mechanism in the apparatus for dispensing food and beverages comprises a downward spring connected to a base plate at one end on which food are stacked over each other and to the top cover on the second end. Referring to FIG. 38, the apparatus comprises an external case 3802 that provide housing for accommodating a food chamber 3804 and a drink chamber 3806 that are placed inside the case and are separated with each other. The food chamber 3804 has a base plate 3812 on which food 3808 are stacked over each other. The apparatus has a lid 3816 on the top of the apparatus 3800 to cover the external case 3802 at top. A first spring 3814 connects the base plate to a lever on the lid 3816 on the top of the apparatus, wherein the first end of the first spring 3814 is connected to the base plate and the second end of the first spring 3814 is connected to the lever on the lid 3816 on the top of the apparatus. A lever 3818 is connected to a plate 3820 at the top of the food chamber 3804. When the lever is manually pushed or pulled, the plate 3820 to push the food stack outside towards a user through an opening provided on the external case 3802. The opening on the external cased can be sealed with a protective sticker or film or a sliding cover to protect food from being exposed to outer environment. The user has to remove the sticker or film before using the apparatus to pop food out. A flexible straw lid can be provided on the top of the apparatus 3800 that extends and runs into the drink chamber 3806.

Figure 39:
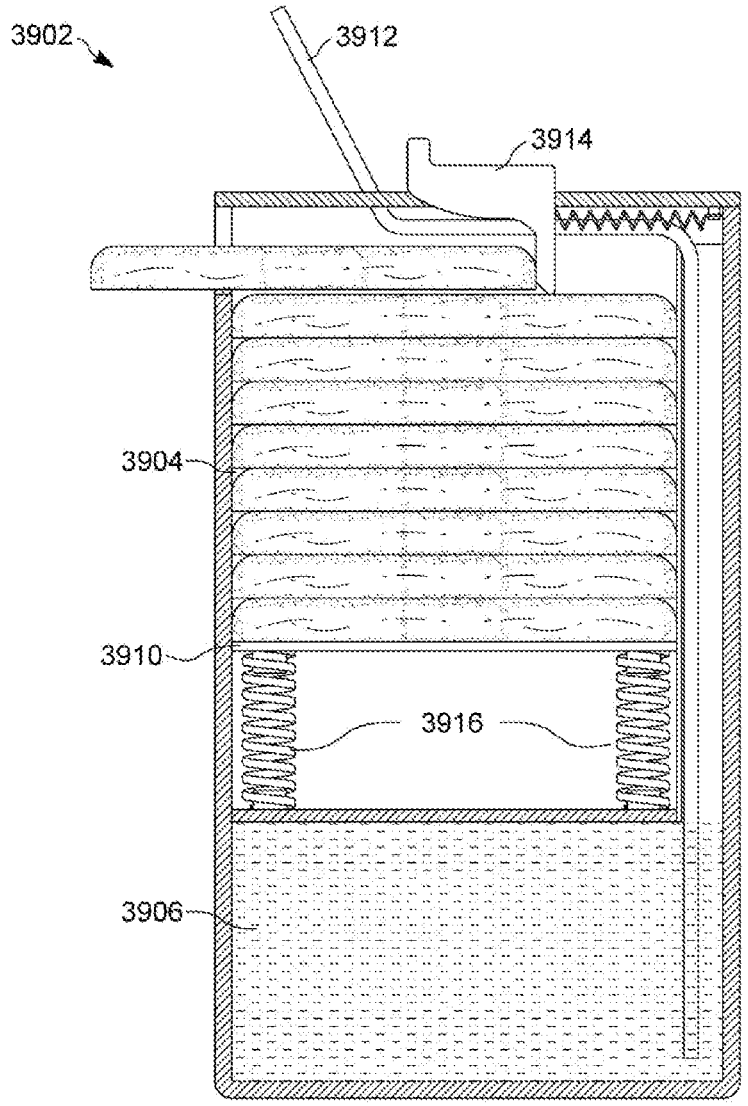
FIG. 39 illustrates the food and drink dispensing apparatus with a food chamber and a drink chamber separated vertically in accordance with another embodiment of present invention.

FIG. 39 illustrates the food and drink dispensing apparatus with a food chamber and a drink chamber separated vertically in accordance with another embodiment of present invention. The apparatus 3902 comprises a food chamber 3904 and a drink chamber 3906 positioned vertically above each other. In the given figure, the drink chamber 3906 is at the bottom of the apparatus 3902. To support the base plate and to provide upward thrust to the food patties, two springs: a first and a second spring 3916 are placed at the top of the drink chamber 3906. The food chamber 3904 has a baseplate 3910 on which food are stacked. The apparatus is covered with a lid. A flexible straw 3912 is extended from the drink chamber 3906 towards the top of the apparatus 3902. A lever 3914 is provided at the top of the food chamber 3904 that is movable along the horizontal axis through a spring connected to the apparatus. The lever has a protruding handle at the top to enable a user to slide it along horizontally. The inside of the lever has a plate that extends down vertically such that the plate lies at the back of the food stack such that when the lever is slides, the plate pushes the stack outward while putting a pressure on the underlying food stack to provide lock and friction mechanism. When the lever 3914 is slides horizontally, the baseplate 3910 moves horizontally and release the food stack outside through an opening provided in the food chamber 3904. The flexible straw shown in FIG. 39 is bend horizontally up, however, alternatively it can be in straight position without any bend.

Figure 40:
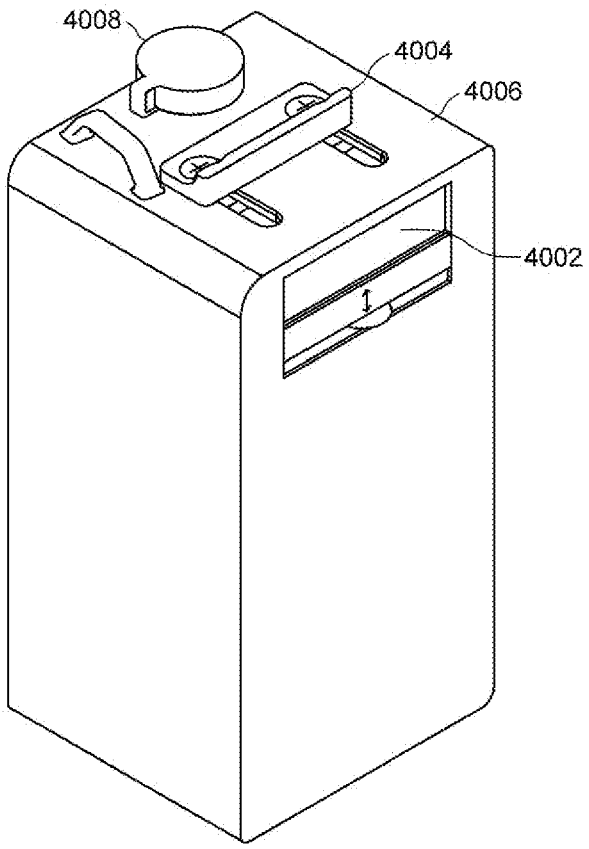
FIG. 40 illustrates an apparatus in square shape for dispensing food and drink in accordance with an embodiment of the present invention.

In an embodiment of the present invention, the shape of the apparatus is not restricted to a circular shape, and the apparatus can be in any geometrical shape. FIG. 40 illustrates an apparatus in square shape for dispensing food and drink. The side of the square shaped apparatus has opening 4002 for dispensing food. A lever 4004 is provided at the top cover 4006 of the apparatus to push the food stack outward. The top cover 4006 further comprises a cap 4008 for the user to drink the content from the drink chamber. The top cover 4006 has a handle to hold the apparatus. The various embodiments described above in circular shape apparatus can be implemented in other shape of the apparatus as well.

In another embodiment of the present invention, the food/patties/fritters can be picked manually from the apparatus. The apparatus comprises a food chamber and a drink chamber. The apparatus has an opening at the front form where the user can manually pick up the food/fritter/patties. The apparatus comprises an external case that provide housing for accommodating a food chamber and a drink chamber that are placed inside the case and are separated with each other. The food chamber has a base plate on which food are stacked over each other. The bottom of the external case has a first spring over which the baseplate of the food chamber is placed. The first spring is in pressed state to store the potential energy, such that when the first spring is released it moves in the upward direction to move the food items towards the top of the apparatus. The apparatus has a lid on the top of the apparatus to cover the external case at top. The external case has a slit opening at the front side from where user can manually pick the food items. The opening on the external cased can be sealed with a protective sticker or film to protect food from being exposed to outer environment. The user has to remove the sticker or film before using the apparatus to pop food out. A flexible straw lid is provided on the top of the apparatus that extends and runs into the drink chamber. The flexible straw lid can be retracted back when not in use and extended when a user wants to drink from the apparatus. Using the flexible straw lid, the user is able to drink the content stored in the drink chamber.

In some aspects, the apparatus of present invention can be used as a disposable container or non-disposable container. For disposable as well as non-disposable container, rapid loading can be done with either through vertical collapsing model or using rotatable opening model. The user can load readymade food stack with tin foil, and the wrapper is removed at one side or all sides. Similarly, drink chamber can also be inserted through below rapid loading. The top of drink chamber can be opened and hole or straw can be used externally. The food stack/patties/fritters can be ejected one by one using various mechanism, such as push/pull springs. This way the product and its ecosystem can easily be adapted to the markets and the users.

In other aspects, the apparatus is provided in disposable, such that the user can directly purchase form vendors. For disposable container, there is no need for user to insert food items and to refill the drinks. This is done on part of manufactures along with food vendors. The disposable apparatus comes with single or dual shell, depending on the requirement.

For container with non-spring models, food patties can be pushed through outside small lever and can be picked with hand or ejected through various lever type mechanism.

Figure 41:
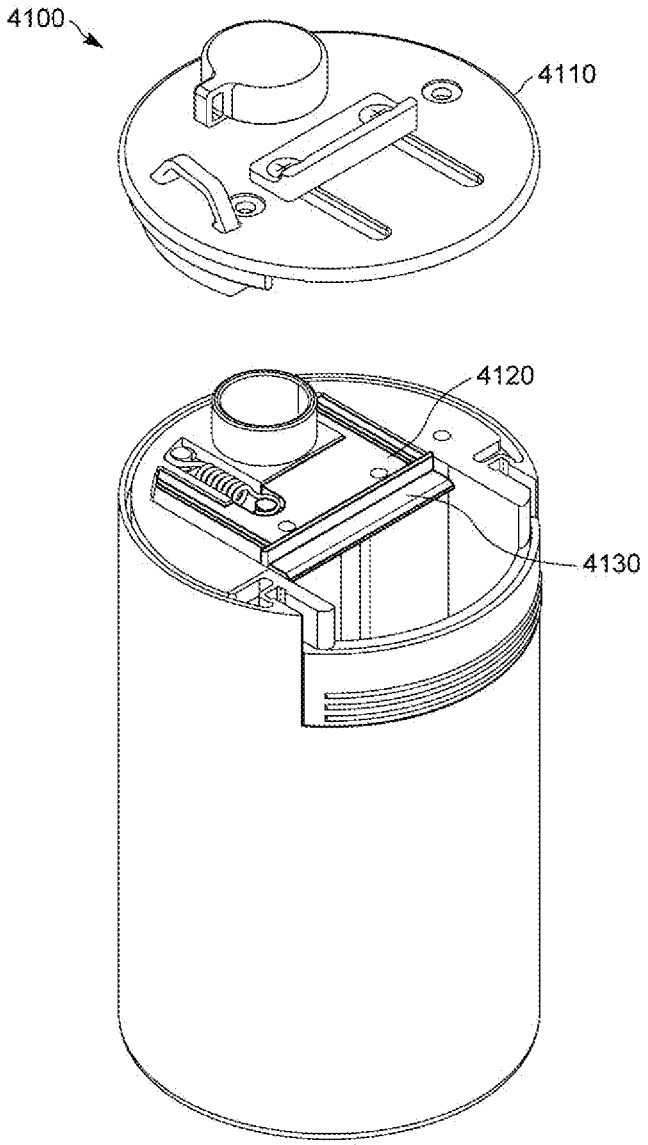
FIG. 41 illustrates extended lever mechanism for pushing high viscous food items (ice creams, custard creams etc.,) towards user.

In another embodiment of the present invention as disclosed in FIG. 41, the apparatus 4100 may also be used for thick, high viscous or semi-solid/liquid creams like ice creams, custard etc. The size of the lid 4110 of the apparatus 4100 is bigger and is easy to open. For storing creams, foams in the apparatus, for some creams maintaining freezing point is required to avoid melting. The modified slide lever 4120 to dispense the cream is an extended slider lever along with horizontal inner slate or flat sharp edged type inner lever 4130 that can scrape/push the semi-solid/creams type of foam to the food exit point. Once the cream is accumulated at the exit point, the user can easily pick up with mouth to consume the accumulated foam/cream. To extend the lever to reach the food exit point, longer slider lever spring is required along with longer slit or guide. When a user wishes to eat the semi-solid foam type food item from the apparatus, the user can slide the modified slide lever 4120 with spring against the base that opens the extended slit in the apparatus and the food in the form of the cream is dispensed towards the user that can be collected by mouth. For each operation, user can use slide lever or spring in the center to push the cream based item to upwards to reach to push through the horizontal slate or blade type inner lever towards user.

In another embodiment, the drink chamber can be used to store semi-liquid type food items like soups, smoothies, puree.

For additional details relating to the present invention, materials and manufacturing techniques of the level of ordinary skill in the art can be used. The same may be true for aspects based on the method of the present invention with respect to additional actions commonly or logically used.

Also, optional features of the described variations of the invention can be described and claimed independently or in combination with any one or more of the features described herein. Similarly, a reference to a singular element includes the possibility that there are pluralities of the same element. More specifically, the singular form ("a," "and," "said," and "the") is not expressly required by the context as used herein and in the appended claims. As long as it includes a plurality of instructions. It is further noted that the claims may be drafted to exclude optional elements.

Therefore, this statement should serve as a preceding basis for the use of exclusive terms such as "simply", "only", etc. or "negative" limitation in connection with the description of the elements of the claims is intended. Unless defined otherwise herein, all technical and scientific terms used herein have the same meaning as commonly understood by one of ordinary skill in the art to which this invention belongs. The scope of the invention is not limited by this specification, but only by the plain meaning of the terms used in the claims.

The invention claimed is:

1. A portable apparatus for dispensing food, said apparatus comprising:

an external case comprising;

a food chamber to store a stack of food fritters and the food chamber includes a food opening;

a drink chamber to store a beverage;

a baseplate in the food chamber to place food fritters;

a first spring placed or attached under the baseplate; the first spring pushes the baseplate upward to toward a lever/button mechanism;

wherein the lever/button mechanism includes a motor for releasing the food from the external casing directly toward the user or at an elevation towards a user through the food opening; wherein actuating the lever/button mechanism activates the motor to push the food fritters toward the user for release through the food opening;

a top lid to cover the apparatus, the top lid is an extension to the external casing;

wherein the lever/button mechanism is in shape of a rotatable lever that rotates around the horizontal axis of the top lid and on rotation activates the motor to push the food fritters towards the user and the first spring loads a next food fritter into lever/button mechanism for further release.

2. The apparatus of claim 1, wherein the top lid comprises the motor connected to the lever that activates the motor to slide over a sliding track and push the food fritters.

3. The apparatus of claim 1, further comprising a lock and skid mechanism to reduce spring tension and friction on food fritters when the lever/button is pressed.

4. The apparatus of claim 1, wherein the apparatus comprises two springs attached to the baseplate, the first spring is present at the center of the food chamber and a second spring is provided at an outer shell end of the food chamber to balance the food stack baseplate to counter wear and tear of a single spring, and wherein when the lever/button is pressed to push the top food fritter towards a user, a second lever holds the rest of food fritters to reduce the friction on the food fritter being released.

5. A portable modular apparatus for dispensing food, said apparatus comprising:

an external case comprising;

a food chamber module to store a stack of food fritters and the food chamber module includes a food opening;

a drink chamber module to store a beverage;

wherein the food chamber module comprises a baseplate in the food chamber to place food fritters;

wherein a first spring is attached to the baseplate, the first spring pushes the baseplate upward toward a lever/button mechanism;

wherein the lever/button mechanism includes a motor for releasing the food from the external casing directly toward the user or at an elevation towards a user through the food opening;

wherein actuating the lever/button mechanism activates the motor to push the food fritters toward the user for release through the food opening and the first spring loads a next food fritter into lever/button mechanism for further release; and a top lid to cover the apparatus, the top lid is an extension to the external casing.

6. The apparatus of claim 5, wherein the food chamber of the apparatus is loaded instantly.

7. The apparatus of claim 6, wherein the loading of the food chamber is through top loading, wherein the vertical food stack patties are loaded through opening of top lid.

8. The apparatus of claim 6, wherein the loading of the food chamber is through vertical or horizontal opening via a hinge, wherein the food container is opened through the hinge and the stack of food fritters are loaded through the opening.

9. The apparatus of claim 6, wherein the loading of the food chamber is through vertical opening through rotatable cover, wherein a cover of the food chamber is opened by rotating the cover clockwise or anti-clockwise and the food fritters are loaded in the food chamber.

10. The apparatus of claim 6, wherein the food chamber is loaded through vertical collapsing wherein a hinge at the bottom of the chamber is pulled down to load the food fritters.

11. The apparatus of claim 5 further comprising a spring tension adjustment screw to adjust tension in the first spring according to the type of food loaded in the food chamber.

12. The apparatus of claim 5, wherein the user can load food fritters into food chamber module and attach to the spring module through magnetic fit, snap fit or through hinge mechanism.

13. The apparatus of claim 5, wherein the user can load drink package into the drink container module and attach to the spring module through magnetic fit, snap fit or through hinge mechanism.

* * * * *